US012806488B2

(12) United States Patent
Carr et al.

(10) Patent No.: US 12,806,488 B2
(45) **Date of Patent: *Nov. 24, 2026**

(54) GOLF CLUB HEAD WITH BALL SPEED CONTROL

(71) Applicant: Acushnet Company, Fairhaven, MA (US)

(72) Inventors: Kyle A. Carr, Carlsbad, CA (US); Jonathan Hebreo, San Diego, CA (US); Richard L. Cleghorn, Oceanside, CA (US); Sang Yi, Carlsbad, CA (US); Richard Sanchez, Temecula, CA (US); Gentry Ferguson, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 234 days.

This patent is subject to a terminal disclaimer.

(21) Appl. No.: 18/676,398

(22) Filed: May 28, 2024

(65) Prior Publication Data

US 2025/0352870 A1 Nov. 20, 2025

Related U.S. Application Data

(63) Continuation-in-part of application No. 18/664,274, filed on May 14, 2024.

(51) Int. Cl.
*A63B 53/04* (2015.01)
*A63B 60/54* (2015.01)

(52) U.S. Cl.
CPC ..... *A63B 53/0475* (2013.01); *A63B 53/045* (2020.08); *A63B 60/54* (2015.10); *A63B 2053/0491* (2013.01)

(58) Field of Classification Search
CPC ..... A63B 53/047; A63B 2053/0491; A63B 53/0475; A63B 60/54; A63B 53/042
USPC ..... 473/324–350, 287–292
See application file for complete search history.

(56) References Cited

U.S. PATENT DOCUMENTS

| | | | | |
|---|---|---|---|---|
| 700,946 | A | 5/1902 | Kempshall | |
| 819,900 | A | 5/1906 | Martin | |
| 1,133,129 | A | 3/1915 | Govan | |
| 1,568,888 | A * | 1/1926 | Dunn | A63B 53/04 473/345 |
| 2,111,249 | A | 3/1938 | Plese | |

(Continued)

FOREIGN PATENT DOCUMENTS

| | | |
|---|---|---|
| JP | 03007178 A | 1/1991 |
| JP | H05-7261 | 2/1993 |

(Continued)

OTHER PUBLICATIONS

MIT, Material Property Databse—Aluminum, uploaded Feb. 20, 2024, M IT.edu, 3 pages.

(Continued)

*Primary Examiner* — Sebastiano Passaniti
(74) *Attorney, Agent, or Firm* — Ryan A. Reis

(57) ABSTRACT

A golf club head including a striking face, a periphery portion surrounding and extending rearwards from the striking face, and a damping element including a first end abutting the striking face. The damping element is installed in the golf club head through an aperture in the periphery portion of the golf club head.

8 Claims, 14 Drawing Sheets

(56) References Cited

U.S. PATENT DOCUMENTS 3,606,327 A * 9/1971 Gorman ..... A63B 53/04 473/297
3,817,522 A 6/1974 Simmons
3,858,886 A 1/1975 Cosby
4,195,842 A 4/1980 Coleman
4,229,550 A 10/1980 Jones et al.
4,398,965 A 8/1983 Campau
4,448,941 A 5/1984 Cheung et al.
4,523,759 A * 6/1985 Igarashi ..... A63B 53/04 73/11.01
4,681,322 A 7/1987 Straza et al.
4,754,977 A 7/1988 Sahm
4,811,950 A 3/1989 Kobayashi
4,826,172 A 5/1989 Antonious
4,928,972 A 5/1990 Nakanishi
4,938,470 A 7/1990 Antonious
4,957,294 A 9/1990 Long
5,048,835 A 9/1991 Gorman
5,056,788 A 10/1991 Katayama
5,058,895 A 10/1991 Igarashi
5,106,094 A 4/1992 Desbiolles et al.
5,121,922 A 6/1992 Harsh, Sr.
5,132,178 A 7/1992 Chyung et al.
5,163,682 A 11/1992 Schmidt et al.
5,178,392 A * 1/1993 Santioni ..... A63B 53/0466 273/153 R
5,184,823 A 2/1993 Desboilles
5,238,529 A 8/1993 Douglas
5,261,664 A 11/1993 Anderson
5,290,032 A 3/1994 Fenton
5,303,922 A 4/1994 Lo
5,310,185 A 5/1994 Viollaz et al.
5,316,298 A 5/1994 Hutin
5,328,176 A 7/1994 Lo
5,328,184 A 7/1994 Antonious
5,346,213 A 9/1994 Yamada
5,346,216 A 9/1994 Aizawa
5,358,249 A 10/1994 Mendralla
5,362,055 A 11/1994 Rennie
5,398,929 A 3/1995 Kitaichi
5,403,007 A 4/1995 Chen
5,405,136 A 4/1995 Hardman
5,405,137 A 4/1995 Vincent
5,425,538 A 6/1995 Vincent et al.
5,431,396 A 7/1995 Shieh
5,433,440 A 7/1995 Lin
5,447,311 A 9/1995 Viollaz et al.
5,464,211 A 11/1995 Atkins, Sr.
5,489,094 A 2/1996 Pritchett
5,492,327 A 2/1996 Biafore, Jr.
5,499,814 A 3/1996 Lu
5,505,453 A 4/1996 Mack
5,524,331 A 6/1996 Pond
5,529,543 A 6/1996 Beaumont, Sr.
5,547,194 A 8/1996 Aizawa
5,547,427 A 8/1996 Rigal
5,586,947 A 12/1996 Hutin
5,586,948 A 12/1996 Mick
5,588,923 A 12/1996 Schmidt
5,626,530 A 5/1997 Schmidt
5,628,697 A 5/1997 Gamble
5,669,829 A 9/1997 Lin
5,697,855 A 12/1997 Aizawa
5,720,673 A 2/1998 Anderson
5,743,813 A 4/1998 Chen et al.
5,766,092 A 6/1998 Mimeur
5,766,093 A 6/1998 Rohrer
5,766,094 A 6/1998 Mahaffey et al.
5,772,527 A 6/1998 Liu
5,827,131 A 10/1998 Mahaffey et al.
5,830,084 A 11/1998 Kosmatka
5,833,551 A 11/1998 Vincent
5,863,261 A 1/1999 Eggiman
5,888,148 A 3/1999 Allen
5,890,973 A 4/1999 Gamble
5,899,821 A 5/1999 Hsu
5,967,903 A 10/1999 Cheng
5,971,868 A 10/1999 Kosmatka
6,001,030 A 12/1999 Delaney
6,015,354 A 1/2000 Ahn
6,042,486 A 3/2000 Gallagher
6,074,309 A 6/2000 Mahaffey
6,162,133 A 12/2000 Peterson
6,165,081 A 12/2000 Chou
6,200,228 B1 3/2001 Takeda
6,238,300 B1 5/2001 Igarashi
6,238,302 B1 5/2001 Helmstetter et al.
D444,195 S 6/2001 Wahl
6,248,025 B1 6/2001 Murphy
6,299,547 B1 10/2001 Kosmatka
6,299,549 B1 10/2001 Shieh
6,302,807 B1 10/2001 Rohrer
6,306,048 B1 10/2001 McCabe
6,309,311 B1 10/2001 Lu
6,354,962 B1 3/2002 Galloway
6,364,789 B1 4/2002 Kosmatka
6,390,932 B1 5/2002 Kosmatka
6,406,382 B1 6/2002 Deshmukh et al.
6,428,427 B1 8/2002 Kosmatka
6,440,008 B2 8/2002 Murphy et al.
6,443,857 B1 9/2002 Chuang
6,508,722 B1 1/2003 McCabe
6,527,650 B2 3/2003 Reyes et al.
6,533,681 B2 3/2003 Inoue et al.
6,595,870 B2 7/2003 Stites
6,605,007 B1 8/2003 Bissonnette et al.
6,612,938 B2 9/2003 Murphy et al.
6,617,013 B2 9/2003 Morrison et al.
6,623,543 B1 9/2003 Zeller et al.
6,638,179 B2 10/2003 Yoshida
6,638,180 B2 10/2003 Tsurumaki
6,648,774 B1 11/2003 Lee
6,672,975 B1 1/2004 Galloway
6,695,715 B1 2/2004 Chikaraishi
D489,106 S 4/2004 Wahl
6,719,641 B2 4/2004 Dabbs
6,743,117 B2 6/2004 Gilbert
6,780,124 B2 8/2004 Lu
6,832,961 B2 12/2004 Sano
6,835,144 B2 12/2004 Best
6,837,094 B2 1/2005 Pringle et al.
6,855,066 B2 2/2005 Best
6,887,164 B2 5/2005 Danwanjee
6,902,495 B2 6/2005 Pergande
6,921,344 B2 7/2005 Gilbert
6,945,876 B2 9/2005 Nakahara et al.
6,949,032 B2 9/2005 Kosmatka
6,964,620 B2 11/2005 Gilbert
6,971,960 B2 12/2005 Dewanjee et al.
6,976,924 B2 12/2005 Gilbert
6,986,715 B2 1/2006 Mahaffey
6,991,559 B2 1/2006 Yabu
7,008,331 B2 3/2006 Chen
7,029,403 B2 4/2006 Rice et al.
7,056,229 B2 6/2006 Chen
7,086,963 B1 8/2006 Onuki et al.
7,096,558 B2 8/2006 Sano
7,101,290 B2 9/2006 Tucker, Sr.
7,108,612 B2 9/2006 Nakahara et al.
7,121,958 B2 10/2006 Cheng et al.
7,125,343 B2 * 10/2006 Imamoto ..... A63B 53/04 473/347
7,140,974 B2 11/2006 Chao et al.
7,140,977 B2 11/2006 Atkins, Sr.
7,160,204 B2 1/2007 Huang
7,169,057 B2 1/2007 Wood et al.
7,175,540 B2 2/2007 Sano
7,182,698 B2 2/2007 Tseng
7,192,365 B2 3/2007 Souza
7,211,006 B2 5/2007 Chang
7,214,143 B2 5/2007 Deshmukh
7,214,144 B2 5/2007 Tseng
7,247,104 B2 7/2007 Poynor
7,267,620 B2 9/2007 Chao et al.

(56) References Cited

U.S. PATENT DOCUMENTS 7,273,420 B2 9/2007 Wright
7,281,990 B2 10/2007 Hagood
7,281,991 B2 10/2007 Gilbert et al.
7,281,994 B2 10/2007 De Shiell et al.
7,303,485 B2 * 12/2007 Tseng ..... A63B 60/006 473/332
7,331,877 B2 2/2008 Yamaguchi et al.
7,371,190 B2 5/2008 Gilbert
7,384,348 B2 6/2008 Lin
7,387,579 B2 6/2008 Lin
7,399,238 B2 7/2008 Hocknell et al.
7,410,428 B1 8/2008 Dawson
7,476,162 B2 1/2009 Stites
7,559,853 B2 7/2009 Hirano
7,575,523 B2 8/2009 Yokota
7,578,755 B2 8/2009 Oyama
7,582,024 B2 9/2009 Shear
7,588,503 B2 9/2009 Roach
7,591,735 B2 9/2009 Matsunaga
7,591,736 B2 9/2009 Ban
7,597,633 B2 10/2009 Shimazaki
7,601,078 B2 10/2009 Mergy et al.
7,604,550 B1 10/2009 Currie
7,628,712 B2 12/2009 Chao et al.
7,651,408 B2 1/2010 Hagood
7,686,706 B2 3/2010 Matsunaga
7,713,141 B2 5/2010 Yamamoto
7,731,604 B2 6/2010 Wahl
7,749,100 B2 7/2010 Tavares
7,753,806 B2 7/2010 Beach
7,775,903 B2 8/2010 Kawaguchi
7,785,212 B2 8/2010 Lukasiewicz, Jr.
7,798,913 B2 9/2010 Noble
7,811,179 B2 10/2010 Roach et al.
7,850,545 B2 12/2010 Wada et al.
7,850,546 B2 12/2010 Chao et al.
7,862,452 B2 1/2011 Chao et al.
7,867,612 B2 1/2011 Schwung et al.
7,871,338 B2 1/2011 Nakano
7,871,340 B2 1/2011 Chao
7,874,938 B2 1/2011 Chao
7,878,920 B2 2/2011 Clausen
7,892,106 B2 2/2011 Matsunaga
7,927,229 B2 4/2011 Jertson et al.
7,935,000 B2 5/2011 Stites
7,967,700 B2 6/2011 Stites
7,985,146 B2 7/2011 Lin et al.
8,088,025 B2 1/2012 Wahl
8,152,652 B2 4/2012 Curtis et al.
8,157,673 B2 4/2012 Gilbert
8,163,119 B2 4/2012 Chao
8,187,116 B2 5/2012 Boyd
8,202,174 B2 6/2012 Breier
8,210,961 B2 7/2012 Finn
8,210,965 B2 7/2012 Roach
8,221,261 B2 7/2012 Curtis et al.
8,247,062 B2 8/2012 Morrison et al.
8,267,807 B2 9/2012 Takechi
8,277,337 B2 10/2012 Shimazaki
8,293,356 B2 10/2012 Merrill et al.
8,303,432 B2 11/2012 Curtis et al.
8,328,663 B2 12/2012 Wahl
8,333,667 B2 12/2012 Kumamoto
8,348,782 B2 1/2013 Park
8,353,784 B2 1/2013 Boyd
8,376,873 B2 2/2013 Golden et al.
8,376,879 B2 2/2013 Wada et al.
8,403,771 B1 3/2013 Rice
8,403,774 B2 3/2013 Stites
8,409,032 B2 4/2013 Myrhum et al.
8,430,986 B1 4/2013 Galloway
8,444,504 B2 5/2013 Chao et al.
8,449,406 B1 5/2013 Frame
8,496,542 B2 7/2013 Curtis et al.
8,506,423 B2 8/2013 Oldknow
8,517,859 B2 8/2013 Golden et al.
8,517,863 B2 8/2013 Wahl
8,535,176 B2 9/2013 Bazzel
8,535,177 B1 9/2013 Wahl
8,562,652 B2 10/2013 Biedermann
8,608,585 B2 12/2013 Stites
8,696,489 B2 4/2014 Gibbs
8,753,219 B2 6/2014 Gilbert
8,753,228 B2 6/2014 Golden
8,758,159 B2 6/2014 Morin
8,758,161 B2 6/2014 Golden et al.
8,777,776 B2 7/2014 Wahl et al.
8,814,725 B2 8/2014 Wahl
8,821,307 B2 9/2014 Park
8,864,603 B2 10/2014 Kumamoto
8,876,629 B2 11/2014 Deshmukh et al.
8,876,630 B2 11/2014 Takeshi
8,920,261 B2 12/2014 Taylor et al.
8,961,336 B1 2/2015 Parsons et al.
9,011,266 B2 4/2015 Brunski
9,022,880 B2 5/2015 Kawaguchi
9,033,818 B2 5/2015 Myrhum
9,033,822 B1 5/2015 DeMille
9,039,543 B2 5/2015 Mizutani
9,101,809 B2 8/2015 Gibbs
9,192,826 B2 11/2015 Golden et al.
9,265,995 B2 2/2016 Wahl
9,283,447 B1 3/2016 DeMille
9,283,448 B2 3/2016 Sander
9,457,241 B2 10/2016 Hebreo
9,539,478 B2 1/2017 Narita
9,597,562 B2 3/2017 Dipert
9,662,549 B2 5/2017 Vrska, Jr.
9,717,960 B2 8/2017 Deshmukh
9,795,844 B1 10/2017 Dacey
9,844,230 B2 12/2017 Bhattacharyya
9,849,354 B2 12/2017 Stokke
9,993,699 B2 6/2018 Larson
9,993,704 B2 6/2018 Hebreo
10,039,965 B1 8/2018 Seluga
10,086,244 B2 10/2018 Morin
10,150,019 B2 12/2018 Ines
10,166,444 B1 * 1/2019 Forshner ..... A63B 60/52
10,220,272 B2 3/2019 Gonzalez
10,293,226 B2 5/2019 Hebreo
10,357,901 B2 7/2019 Deshmukh
10,391,370 B2 8/2019 Tassistro
10,413,789 B1 9/2019 Seluga
10,463,933 B2 * 11/2019 Mata ..... A63B 53/047
10,471,319 B1 11/2019 Mata
10,625,126 B2 * 4/2020 Demkowski ..... A63B 53/047
10,625,127 B2 4/2020 Golden
10,821,338 B2 11/2020 Hebreo
10,821,344 B2 11/2020 Mata
10,960,272 B2 3/2021 Kawaguchi
11,020,639 B2 6/2021 Golden
11,090,532 B2 8/2021 Wahl
11,090,534 B2 8/2021 Westrum
11,192,003 B2 12/2021 Parsons
11,235,212 B2 * 2/2022 Clarke ..... A63B 53/0475
11,465,018 B2 10/2022 Stokke
11,491,377 B1 11/2022 Sanchez
11,565,158 B1 * 1/2023 Parsons ..... A63B 60/02
11,648,445 B2 * 5/2023 Wang ..... A63B 60/54 473/332
11,654,339 B2 * 5/2023 Clarke ..... A63B 60/02 473/324
11,666,809 B2 * 6/2023 Jertson ..... A63B 53/0433 473/345
11,679,313 B2 6/2023 Luttrell
2001/0051549 A1 12/2001 Inoue et al.
2002/0019265 A1 2/2002 Allen
2002/0098910 A1 7/2002 Gilbert
2002/0113338 A1 8/2002 Murphy
2002/0165040 A1 11/2002 Kosmatka
2002/0187852 A1 12/2002 Kosmatka et al.
2003/0092502 A1 5/2003 Pergande
2003/0157995 A1 8/2003 Mahaffey
2003/0183328 A1 10/2003 Lee

(56) References Cited

U.S. PATENT DOCUMENTS

2003/0190975 A1 10/2003 Fagot
2003/0228928 A1 12/2003 Yabu
2004/0214654 A1 10/2004 Pelz
2004/0266550 A1 12/2004 Gilbert et al.
2005/0003900 A1 1/2005 Sugimoto
2005/0003903 A1 1/2005 Galloway
2005/0009624 A1 1/2005 Long
2005/0020378 A1 1/2005 Krumme
2005/0043117 A1 2/2005 Gilbert
2005/0049079 A1 3/2005 Yamamoto
2005/0064956 A1 3/2005 Lee
2005/0101406 A1 5/2005 Hirano
2005/0107183 A1 5/2005 Takeda
2005/0124437 A1 6/2005 Imamoto
2005/0209024 A1 9/2005 Oyama
2005/0215352 A1 9/2005 Oyama
2005/0239576 A1 10/2005 Stites
2005/0277485 A1 12/2005 Hou
2006/0052185 A1 3/2006 Kawaguchi
2006/0138199 A1* 6/2006 Chen ..... B23K 13/015 228/115
2006/0220279 A1 10/2006 Reyes
2006/0229141 A1 10/2006 Galloway
2006/0234805 A1 10/2006 Gilbert
2007/0026961 A1 2/2007 Hou
2007/0060414 A1 3/2007 Breier
2007/0099722 A1 5/2007 Stevens
2007/0135233 A1 6/2007 Perras
2008/0004131 A1 1/2008 Lin
2008/0051219 A1 2/2008 Erickson
2008/0076595 A1 3/2008 Lai et al.
2008/0096687 A1 4/2008 Chen
2008/0149267 A1 6/2008 Chao
2008/0268980 A1 10/2008 Breier
2008/0287216 A1 11/2008 Nakamura
2008/0289747 A1 11/2008 Modin
2008/0293511 A1 11/2008 Gilbert et al.
2008/0300068 A1 12/2008 Chao
2008/0305888 A1 12/2008 Tseng
2009/0137339 A1 5/2009 Nakano
2009/0156324 A1 6/2009 Cole
2009/0163293 A1 6/2009 Gibb
2009/0163295 A1 6/2009 Tseng
2009/0247314 A1 10/2009 Matsunaga
2009/0325729 A1 12/2009 Takechi
2010/0056296 A1 3/2010 Kumamoto
2010/0056297 A1 3/2010 Roach
2010/0125000 A1 5/2010 Lee
2010/0273565 A1 10/2010 Stites
2010/0273570 A1 10/2010 Ines
2011/0065528 A1 3/2011 Dawson
2011/0124432 A1 5/2011 Oldknow
2011/0159981 A1 6/2011 Bazzel
2011/0250985 A1 10/2011 Stites
2011/0256954 A1 10/2011 Soracco
2012/0064997 A1 3/2012 Sato
2012/0135822 A1 5/2012 Deshmukh
2012/0172143 A1 7/2012 Greaney
2012/0172144 A1 7/2012 Mazutani
2012/0289363 A1 11/2012 Myrhum et al.
2013/0040754 A1 2/2013 Morin
2013/0040756 A1 2/2013 Myrhum
2013/0040757 A1 2/2013 Deshmukh
2013/0109497 A1* 5/2013 Ban ..... A63B 53/047 473/330
2013/0130827 A1 5/2013 Boyd
2013/0252757 A1 9/2013 Deshmukh et al.
2013/0281227 A1 10/2013 Roach
2013/0316847 A1 11/2013 Wallans
2013/0324297 A1 12/2013 Larson
2013/0324301 A1 12/2013 Boyd
2014/0038737 A1 2/2014 Roach
2014/0038747 A1 2/2014 Dolezel
2014/0038749 A1 2/2014 Beach
2014/0256467 A1 9/2014 Lorentzen
2014/0274454 A1 9/2014 Snyder
2014/0274456 A1 9/2014 Cardani
2014/0323237 A1 10/2014 Beno
2015/0045146 A1 2/2015 Deshmukh et al.
2015/0108681 A1 4/2015 Deshmukh
2015/0111664 A1 4/2015 Myrhum
2015/0111665 A1* 4/2015 Ines ..... A63B 53/047 228/155
2015/0165280 A1 6/2015 Hebreo
2015/0343281 A1 12/2015 Ban
2015/0375068 A1 12/2015 Mizutani
2016/0144246 A1 5/2016 Onuki
2016/0193508 A1 7/2016 Issertell
2016/0346636 A1 12/2016 Sander
2016/0361609 A1* 12/2016 Ines ..... A63B 53/047
2017/0028271 A1 2/2017 Petersen
2017/0144037 A1 5/2017 Dipert
2017/0239533 A1 8/2017 Cole
2017/0333765 A1 11/2017 Parsons
2018/0008870 A1 1/2018 Cornelius
2018/0028882 A1 2/2018 Hebreo
2018/0028883 A1 2/2018 Morin
2018/0093145 A1 4/2018 Ripp
2018/0133565 A1 5/2018 Hebreo
2018/0185717 A1 7/2018 Demkowski
2018/0200593 A1 7/2018 Golden
2018/0345106 A1 12/2018 Kitagawa
2019/0015711 A1 1/2019 Abe
2019/0126108 A1 5/2019 Parsons et al.
2019/0134473 A1 5/2019 Golden
2019/0151722 A1 5/2019 Gonzalez
2019/0168087 A1* 6/2019 Martens ..... A63B 53/0466
2019/0201760 A1 7/2019 Golden et al.
2019/0217162 A1 7/2019 Seagram
2019/0224533 A1 7/2019 Spackman
2019/0240733 A1 8/2019 Chen
2020/0023244 A1 1/2020 Parsons
2020/0061422 A1 2/2020 Chuang
2020/0086386 A1 3/2020 Koehler
2020/0222767 A1 7/2020 Golden
2020/0230471 A1 7/2020 Parsons
2020/0298077 A1 9/2020 Clarke
2020/0368591 A1* 11/2020 Hebreo ..... A63B 53/0466
2021/0016137 A1 1/2021 Cleghorn
2021/0046360 A1 2/2021 Demkowski
2021/0046363 A1 2/2021 Golden
2021/0106887 A1 4/2021 Gonzalez
2021/0121748 A1 4/2021 Ines
2021/0146206 A1* 5/2021 Hill ..... A63B 60/02
2021/0236887 A1 8/2021 Demkowski
2022/0111268 A1* 4/2022 Johnson ..... A63B 53/042
2022/0233924 A1* 7/2022 Woodward ..... A63B 53/0416
2022/0370864 A1 11/2022 Lambeth
2024/0042287 A1 2/2024 Ripp
2024/0050817 A1 2/2024 Carr
2024/0100403 A1* 3/2024 Spackman ..... A63B 53/047
2025/0135302 A1* 5/2025 Degerness ..... A63B 53/0466

FOREIGN PATENT DOCUMENTS

JP H11-192329 5/2001
JP 2001-170222 6/2001
JP 2003284794 A 10/2003
JP 2006-000139 A 1/2006
JP 2007-21171 1/2007
JP 2009-61317 3/2009
JP 4291836 8/2009
JP 2009240365 A 10/2009

(56) References Cited

FOREIGN PATENT DOCUMENTS

| | | |
|---|---|---|
| JP | 2015-517882 | 6/2015 |
| KR | 10-2017-0008275 | 11/2015 |

OTHER PUBLICATIONS

The Royal and Ancient Golf Club of St. Andrews and USGA, Technical Description of the Pendulum Test, Revised Version, Nov. 2003.
Machine Translation of JPH05-7261.

* cited by examiner

GOLF CLUB HEAD WITH BALL SPEED CONTROL

RELATED APPLICATIONS

This application is a continuation-in-part of U.S. patent application Ser. No. 18/664,274, filed on May 14, 2024, which is hereby incorporated by reference in its entirety.

BACKGROUND

It is a goal for golfers to reduce the total number of swings needed to complete a round of golf, thus reducing their total score. To achieve that goal, it is generally desirable to for a golfer to have a ball fly a consistent distance when struck by the same golf club and, for some clubs, also to have that ball travel a long distance. For instance, when a golfer slightly mishits a golf ball, the golfer does not want the golf ball to fly a significantly different distance. At the same time, the golfer also does not want to have a significantly reduced overall distance every time the golfer strikes the ball, even when the golfer strikes the ball in the "sweet spot" of the golf club. Additionally, it is also preferable for a golf club head to produce a pleasant sound to the golfer when the golf club head strikes the golf ball.

SUMMARY

In some aspects, the techniques described herein relate to a golf club head including: a striking face having a front surface configured to strike a golf ball and a rear surface opposite the front surface; a periphery portion extending rearward from the striking face and including a sole, a topline opposite the sole, a heel side, a toe side opposite the heel side, and a back portion extending from the sole to the topline and from the heel side to the toe side; a hosel configured to receive a shaft, the hosel located on the heel side; a cavity formed between the periphery portion and the striking face; an aperture extending through the toe side and into the cavity; a support pad within the cavity attached to the back portion; and a damping element positioned between the support pad and the rear surface of the striking face.

In some aspects, the techniques described herein relate to a method of manufacturing a golf club head including: providing a striking face having a front surface configured to strike a golf ball and a rear surface opposite the front surface; providing a periphery portion extending rearward from the striking face and including a sole, a topline opposite the sole, a heel side, a toe side opposite the heel side, and a back portion extending from the sole to the topline and from the heel side to the toe side, wherein a cavity is formed between the periphery portion and the striking face; providing a hosel configured to receive a shaft, the hosel located on the heel side; providing an aperture extending through the toe side and into the cavity; and inserting a damping element through the aperture into the cavity.

In some aspects, the techniques described herein relate to a golf club head including: a striking face having a front surface configured to strike a golf ball and a rear surface opposite the front surface; a periphery portion extending rearward from the striking face and including a sole, a topline opposite the sole, a heel side, a toe side opposite the heel side, and a back portion extending from the sole to the topline and from the heel side to the toe side; a hosel configured to receive a shaft, the hosel located on the heel side; a cavity formed between the periphery portion and the striking face; a toe cap defined by at least a portion of the periphery portion at the toe side, the toe cap being a separate component from a remainder of the golf club head; and a damping element positioned between the back portion and the rear surface of the striking face.

In some aspects, the techniques described herein relate to a method of manufacturing a golf club head including: providing a striking face having a front surface configured to strike a golf ball and a rear surface opposite the front surface; providing a periphery portion extending rearward from the striking face and including a sole, a topline opposite the sole, a heel side, a toe side opposite the heel side, and a back portion extending from the sole to the topline and from the heel side to the toe side, wherein a cavity is formed between the periphery portion and the striking face; providing a hosel configured to receive a shaft, the hosel located on the heel side; providing a toe cap defined by at least a portion of the periphery portion at the toe side, the toe cap being a separate component from a remainder of the golf club head; inserting a damping element within the cavity; and securing the toe cap to the remainder of the golf club head to enclose the cavity.

BRIEF DESCRIPTION OF THE DRAWINGS

Non-limiting and non-exhaustive examples are described with reference to the following Figures.

DETAILED DESCRIPTION

The technologies described herein contemplate an iron-type golf club head that incorporates a damping element to promote more uniform ball speed across the striking face of the golf club head. Traditional thin-faced iron-type golf clubs generally produce less uniform launch velocities across the striking face due to increased compliance at the geometric center of the striking face. For example, when a golf club strikes a golf ball, the striking face of the club deflects and then springs forward, accelerating the golf ball off the striking face. While such a design may lead to large flight distances for a golf ball when struck in the center of the face, any off-center strike of the golf ball causes significant losses in flight distance. In comparison, an extremely thick face causes more uniform ball flight regardless of impact location, but it causes a significant loss in launch velocities. The present technology incorporates a damping element between a back portion of the hollow iron and the rear surface of the striking face. By including the damping element, the magnitude of the launch velocity may be reduced for strikes at the center of the face while improving uniformity of launch velocities across the striking face. The damping element compression and/or material may be selected to achieve desired deflection of the striking face depending on particular swing types and golfer needs.

Figure 1:
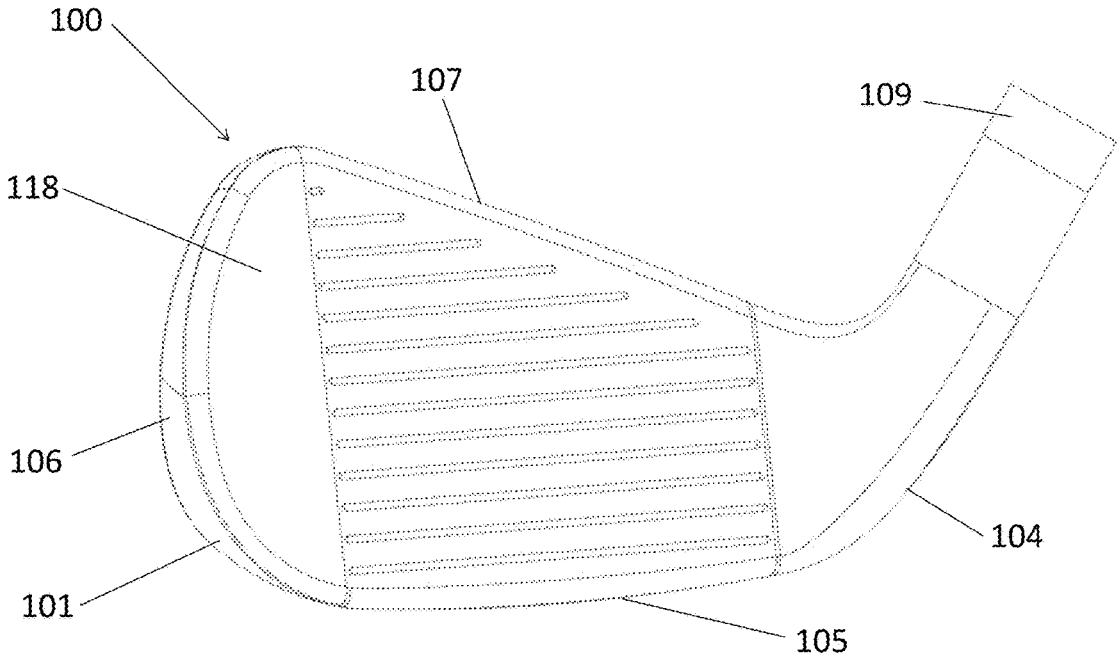
FIG. 1 depicts a front perspective view of a golf club head in accordance with an embodiment of the present invention.
Figure 2:
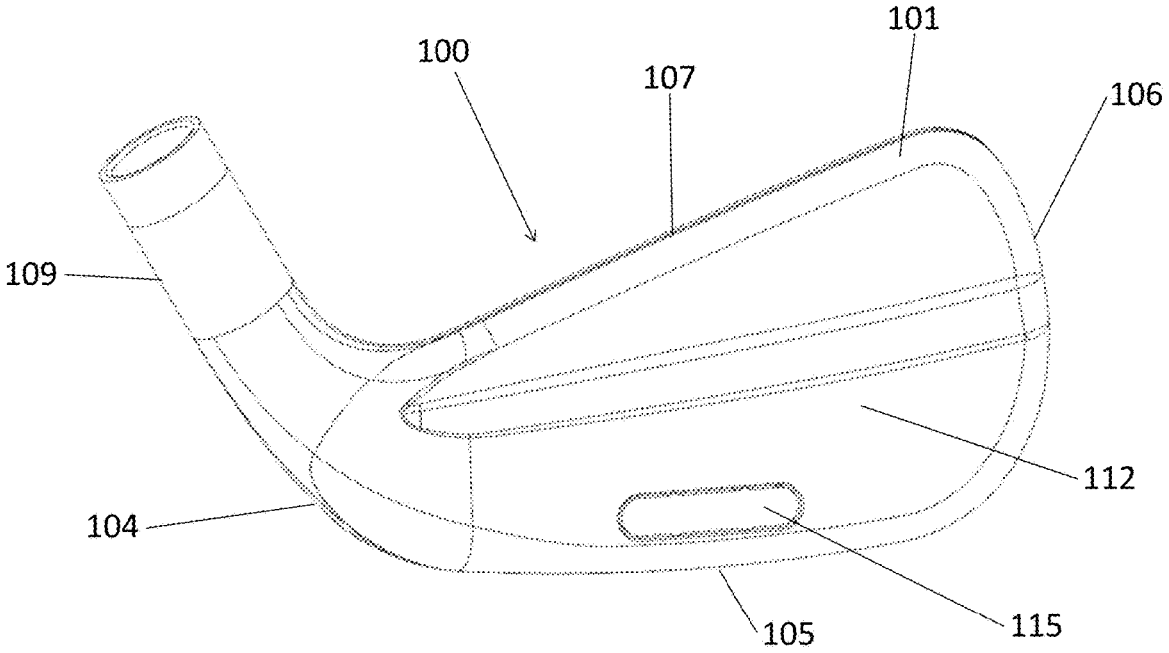
FIG. 2 depicts a rear view of the golf club head of FIG. 1.
Figure 3:
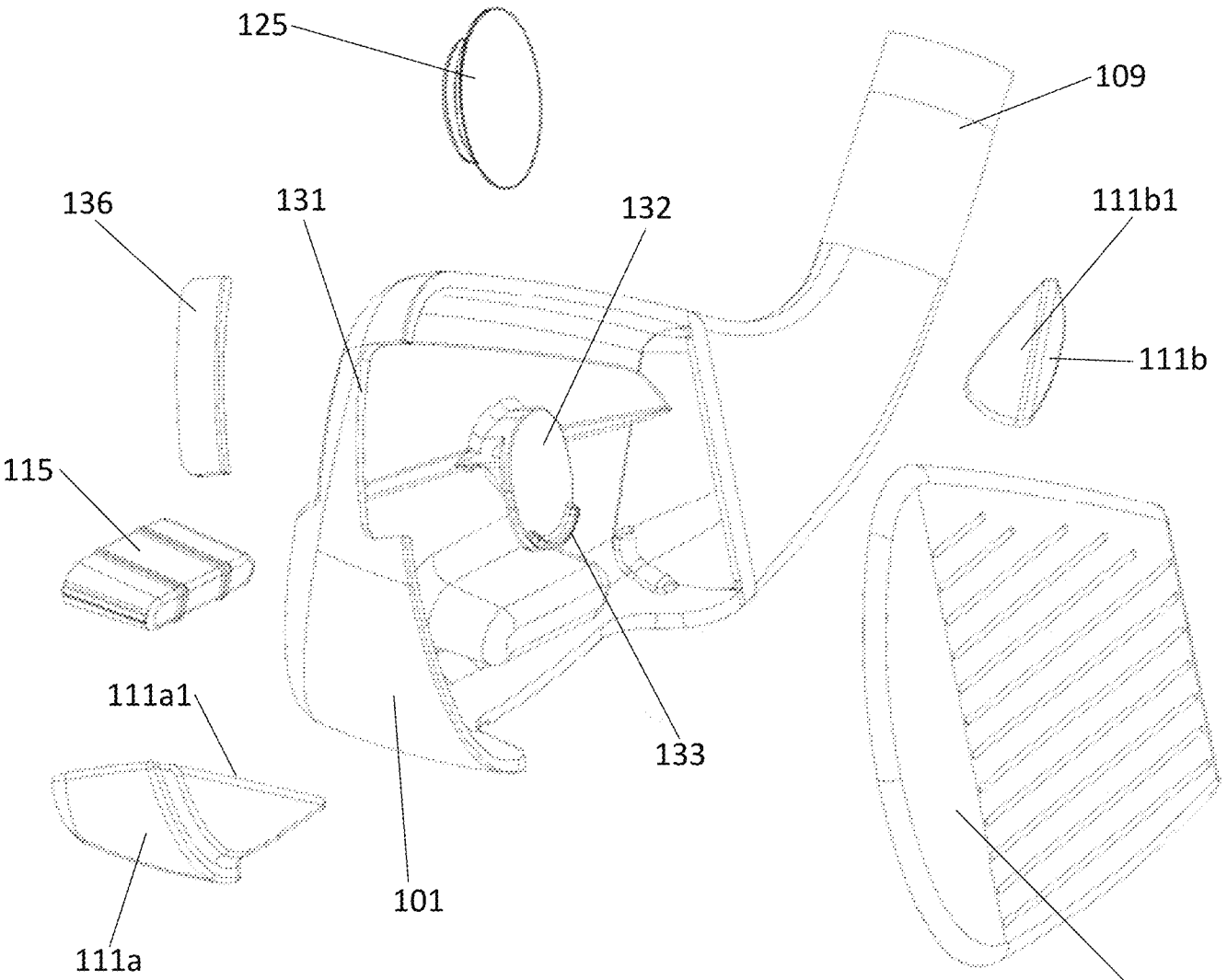
FIG. 3 depicts an exploded perspective view of the golf club head of FIG. 1.
Figure 5:
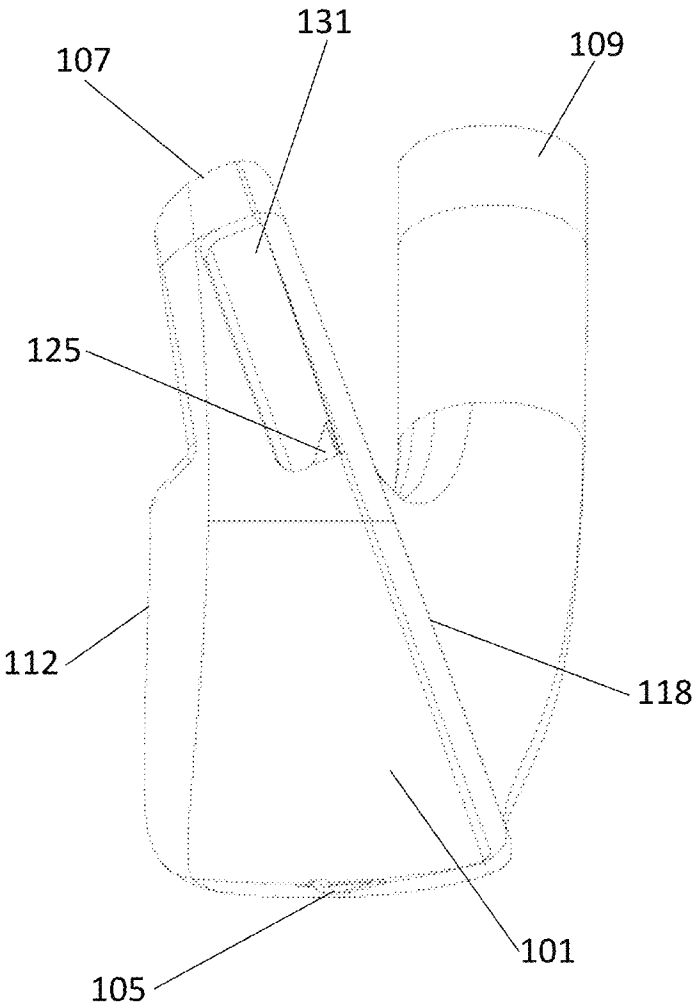
FIG. 5 depicts a toe side view of the golf club head of FIG. 1 with a toe portion removed.
Figure 4:
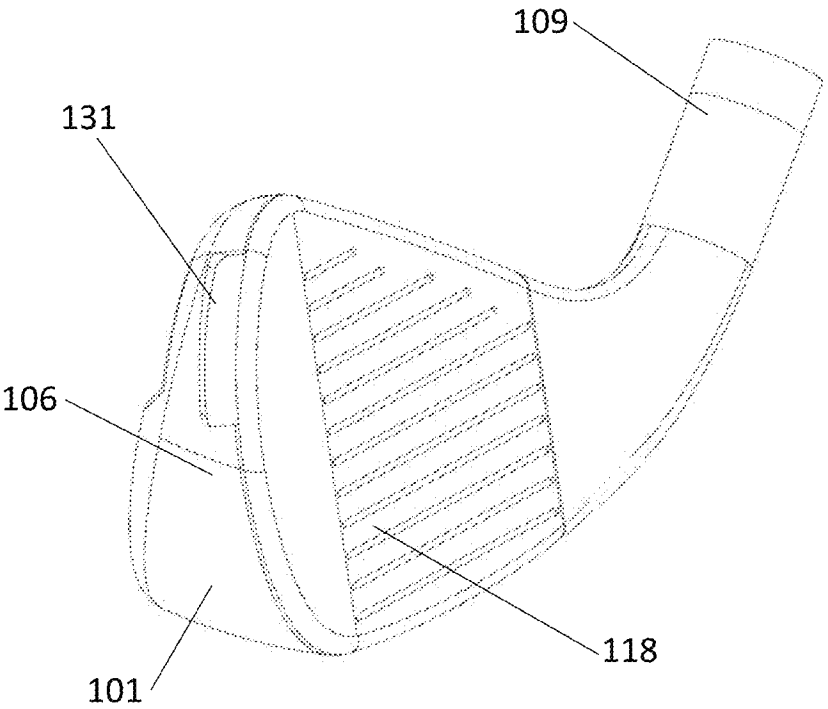
FIG. 4 depicts a front perspective view of the golf club head of FIG. 1 with a toe portion removed.
Figure 6:
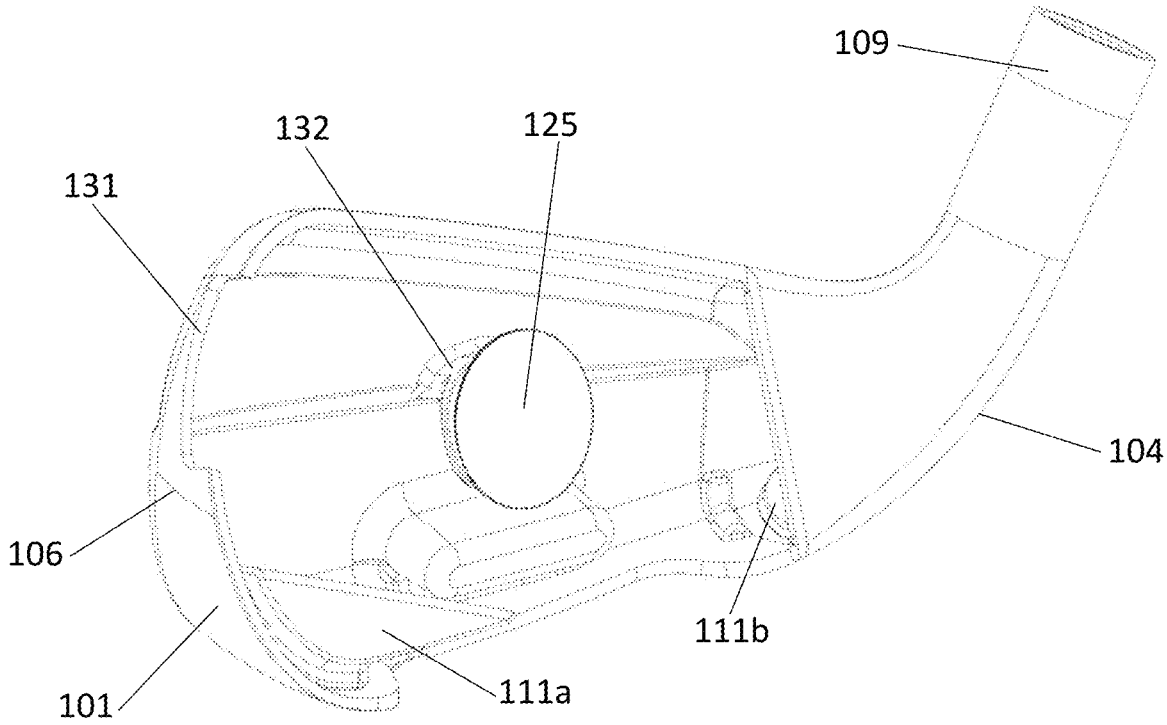
FIG. 6 depicts a front perspective view of the golf club head of FIG. 1 with the striking face removed.
Figure 7:
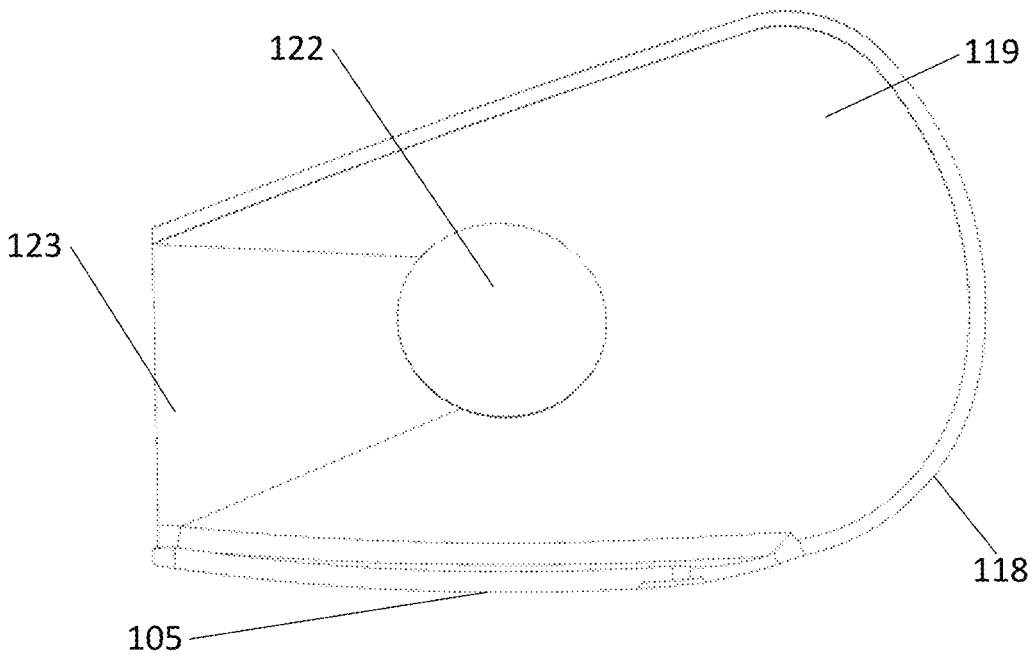
FIG. 7 depicts a rear view of a striking face.
Figure 8:
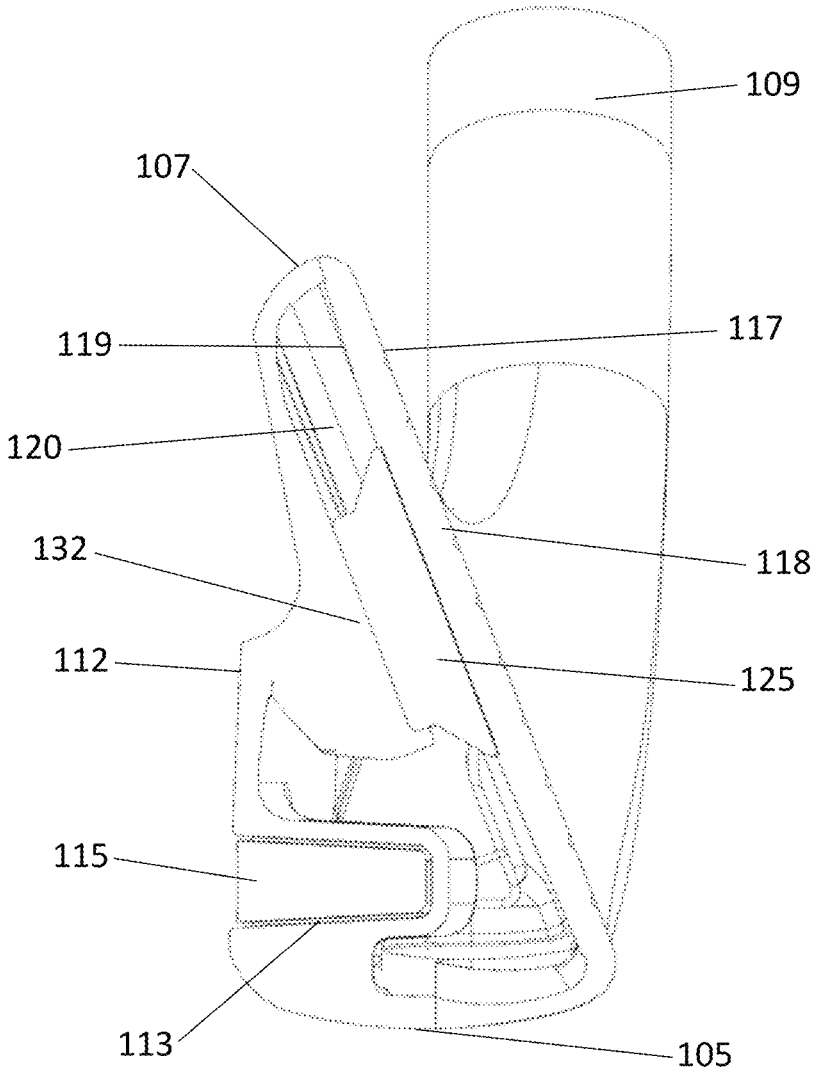
FIG. 8 depicts a side cross-sectional view of the golf club head of FIG. 1.
Figure 9:
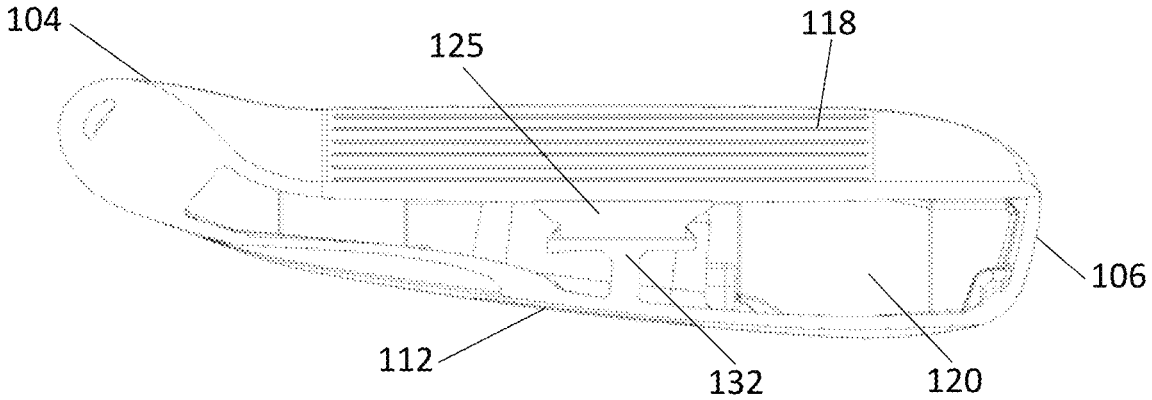
FIG. 9 depicts a top cross-sectional view of the golf club head of FIG. 1.

FIGS. 1-9 depict a golf club head 100 having a damping element 125 positioned behind the striking face 118. FIG. 1 depicts a front perspective view of the golf club head 100. FIG. 2 depicts a rear view of the golf club head 100. FIG. 3 depicts an exploded perspective view of the golf club head 100. FIG. 4 depicts a front perspective view of the golf club head 100 with a toe portion removed. FIG. 5 depicts a toe side view of the golf club head 100 with a toe portion removed. FIG. 6 depicts a front perspective view of the golf club head 100 with the striking face 118 removed. FIG. 7 depicts a rear view of the striking face 118. FIG. 8 depicts a side cross-sectional view of the golf club head 100. FIG. 9 depicts a top cross-sectional view of the golf club head 100.

The golf club head 100 illustrated in FIGS. 1-9 is an iron type golf club head having a hollow body construction and includes a periphery portion 101 surrounding and extending rearward from a striking face 118. The periphery portion 101 includes a sole 105, a topline 107 opposite the sole 105, a heel side 104, and a toe side 106 opposite the heel side 104. The periphery portion 101 also includes a back portion 112 extending from the sole 105 to the topline 107 and extending from the heel side 104 to the toe side 106. The golf club head 100 includes a hosel 109 located on the heel side 104 configured to receive a shaft (not shown). A cavity 120 is formed between the periphery portion 101 and the striking face 118. The striking face 118 can be formed separately and welded to the periphery portion 101. In other embodiments, the striking face 118 may be formed integrally with the periphery portion 101.

The golf club head 100 further includes a damping element 125 located within the cavity 120. The damping element 125 has a front portion that contacts a rear surface 119 of the striking face 118. A rear portion of the damping element 125 contacts a support pad 132. The support pad 132 is attached to the back portion 112 of the golf club head 100. The support pad 132 includes a raised lip 133 projecting towards the striking face 118 which is critical for positioning the damping element 125 in the proper orientation on the support pad 132 during assembly when visual inspection is obscured. The raised lip 133 has a shape which complements the shape of the rear portion of the damping element 125 to prevent the damping element 125 from sliding or otherwise moving out of position once installed. In a preferred embodiment, the raised lip 133 has an arcuate shape to complement a rounded rear portion of the damping element 125. In addition to the raised lip 133, the damping element 125 is generally held in place due to compression of the damping element 125 between the support pad 132 and the rear surface 119 of the striking face 118. The damping element 125 is configured to be installed in a set position during assembly and remain in that position. The support pad 132 and the raised lip 133 help to ensure the damping element 125 is installed consistently and that the damping element 125 properly and consistently engages the rear surface 119 of the striking face 118 for optimal performance. An epoxy may be used to further secure the damping element 125 to the support pad 132 and/or the rear surface 119 of the striking face 118. The epoxy may also provide acoustic damping for desired sound characteristics.

The damping element 125 may have a generally frusto-conical shape. In other examples, the damping element 125 may have a cylindrical, hemispherical, cuboid, or prism shape. The support pad 132 is formed to substantially match the shape of the rear portion of the damping element 125. The support pad 132 may be welded or otherwise attached to the back portion 112, or the support pad 132 may be formed as part of the back portion 112 during a casting or forging process. The back portion 112 may also be machined to include the support pad 132. The support pad 132 is oriented substantially parallel to the rear surface 119 of the striking face 118. The support pad 132 does not come into contact with the rear surface 119 of the striking face 118 at maximum deflection thereof. The support pad 132 itself may be made of the same material as the back portion 112, such as a steel. The support pad 132 may also be made from titanium, aluminum, composite, or ceramic materials.

The periphery portion 101 includes an aperture 131 on the toe side 106 to allow installation of the damping element 125 within the cavity 120. This is critical for allowing the damping element 125 to be positioned between the support pad 132 and the rear surface 119 of the striking face 118 after the striking face 118 has been welded or otherwise attached to the periphery portion 101. In one embodiment where the striking face 118 is welded to the periphery portion 101, installing the damping element 125 after the striking face 118 has been welded protects the damping element 125 from adverse heat effects that the damping element 125 would be subjected to if it were installed prior to the welding process.

In another embodiment where the striking face 118 is formed integrally with the periphery portion 101, installing the damping element 125 through the aperture 131 provides a minimally invasive assembly without the need for larger access openings and more complex finishing steps to enclose the cavity 120. The aperture 131 is sized to allow the damping element 125 to slide through the aperture 131 and be positioned between the support pad 132 and the rear surface 119 of the striking face 118. In one embodiment, the aperture 131 has a maximum height in the sole-to-topline direction that approximately equals the maximum height of the damping element 125, and the aperture 131 has a maximum width in the front-to-rear direction that approximately equals the maximum width of the damping element 125. The raised lip 133 assists in guiding the damping element 125 to its proper position. Once the damping element 125 is installed, a cap 136 covers the aperture 131 to prevent unwanted debris and moisture from entering the cavity 120. The cap 136 may be attached using an adhesive. Alternatively, the cap 136 may be attached by welding, preferably pulse welding. Pulse welding the cap 136 over the aperture 131 involves welding smaller sections of the weld path in multiple passes. This is critical for allowing the golf club head 100 to cool down in between welding passes to prevent excessive heat exposure to the damping element 125. Preferably, the aperture 131 is sized just big enough to permit the damping element 125 to pass through during assembly. The relatively small size of the aperture 131 provides minimal heat exposure time for the damping element 125 when the cap 136 is welded over the aperture 131. Additionally, the location of the aperture 131 on the toe side 106 of the periphery portion 101 provides a maximum separation distance from the heat exposure for the damping element 125 when the cap 136 is welded over the aperture 131.

In a preferred method of manufacturing the golf club head 100, the striking face 118 is welded to, or integrally formed with, the periphery portion 101. The damping element 125 is then inserted into the cavity 120 through the aperture 131 located on the toe side 106 of the periphery portion 101. The damping element 125 is positioned between the support pad 132 and the rear surface 119 of the striking face 118. The raised lip 133 assists in locating the proper positioning of the damping element 125 and helps prevent unwanted movement of the damping element 125 once properly installed. The cap 136 is then welded or adhered to the periphery portion 101 to cover the aperture 131 and enclose the cavity 120.

In traditional thin face golf clubs, strikes at the geometric center of the striking face display the largest displacement of the striking face, and thus the greatest ball speeds. By disposing the damping element 125 proximate the geometric center of the striking face 118, the deflection of the striking face 118 at that point is reduced, thus reducing the ball speed. Portions of the striking face 118 not backed by the damping element 125, however, continue to deflect into the cavity 120 contributing to the speed of the golf ball. As such, a more uniform distribution of ball speeds resulting from ball strikes across the striking face 118 from the heel side 104 to the toe side 106 may be achieved.

The elasticity of the damping element 125 affects the deflection of the striking face 118. For instance, a material with a lower elastic modulus allows for further deflection of the striking face 118, providing for higher maximum ball speeds but less uniformity of ball speeds. In contrast, a material with a higher elastic modulus further prevents deflection of the striking face 118, providing for lower maximum ball speeds but more uniformity of ball speeds. For some applications, a range of elastic moduli for the damping element 125 from about 4 MPa to about 15 GPa may be used. In other applications, a range of elastic moduli for the damping element 125 from about 15 to about 40 GPa may be used. To achieve the goal of having the carry distance of off-center shots closer to the carry distance of center shots, the material for the damping element 125 may have an elastic modulus of about 40 GPa or greater, and more preferably about 70 GPa or greater. The material for the damping element 125 may be a polymer, preferably silicone, to achieve the lower elastic modulus for higher ball speeds or a metal such as aluminum, steel, or titanium to achieve the higher elastic modulus for more consistent carry distances across the striking face 118. Although the maximum ball speed for impacts at the center decreases when the damping element 125 has a higher elastic modulus, the speed retention across the striking face 118 is improved. This is desirable for golfers who want more consistent carry distance from strikes across the striking face 118 rather than maximizing overall carry distance.

The damping element 125 has a free thickness and an installed thickness measured in the front-to-rear direction. In some embodiments, the free thickness and the installed thickness of the damping element 125 can be substantially the same. In this case, there would be little to no preload of the damping element 125 against the rear surface 119 of the striking face 118. In other embodiments, the installed thickness can be lower than the free thickness, creating a preload force on the rear surface 119 of the striking face 118. This preload force can change the coefficient of restitution of the striking face 118. In an additional embodiment, multiple versions of the damping element 125 may be available with different free thicknesses to achieve a particular coefficient of restitution. Alternatively, the material of the damping element 125 could be altered to change its stiffness, thus altering the coefficient of restitution of the golf club head.

A higher compression of the damping element 125 against the rear surface 119 of the striking face 118 further restricts the deflection of the striking face 118. In turn, further restriction of the deflection causes more uniform ball speeds across the striking face 118. However, the restriction on deflection also lowers the maximum ball speed from the center of the striking face 118. To achieve a golf club head 100 that produces further maximum distance, but does not need uniform ball speed across the striking face 118, the initial set compression of the damping element 125 can be reduced, or a damping element 125 having a lower elastic modulus can be used. In contrast, to achieve a golf club head 100 that has more uniform ball speed across the striking face 118, the initial set compression of the damping element 125 can be increased, or a damping element 125 having a higher elastic modulus can be used. This adjustability is critical for meeting a variety of specific performance needs for different individuals.

The inclusion of the damping element 125 in the golf club head 100 provides benefits in durability for the striking face 118 by reducing stress values displayed by the striking face 118 upon impact with a golf ball. Without the damping element 125, the von Mises stress levels are high and indicate that the striking face 118 may be susceptible to failure and/or early deterioration. Such von Mises stress values are lower with the damping element 125 and are indicative of a more durable golf club head 100 that is less likely to fail.

Another goal of the damping element 125 described herein is to dissipate energy of the golf club head after it strikes a golf ball. As the striking face 118 and other portions of the golf club head vibrate, the damping element 125 in contact with those surfaces can dissipate the energy. This can change the sound produced by the golf club head 100 by reducing the loudness and/or duration of the sound produced when the golf club head 100 strikes a golf ball.

As shown in FIGS. 3 and 6, the periphery portion 101 is configured to receive a first weight member 111*a* positioned proximate the toe side 106 and a second weight member 111*b* positioned proximate the heel side 104. The first weight member 111*a* has an angled upper surface 111*al* such that the first weight member 111*a* has a maximum height in a sole-to-topline direction at a toewardmost point and a minimum height in the sole-to-topline direction at a heelwardmost point. This shape of the first weight member 111*a* allows increased weight concentration toeward and soleward for higher moment of inertia and forgiveness. The second weight member 111*b* has an angled upper surface 111*b*1 such that the second weight member 111*b* has a maximum height in a sole-to-topline direction at a heelwardmost point and a minimum height in the sole-to-topline direction at a toewardmost point. This shape of the second weight member 111*b* allows increased weight concentration heelward and soleward for higher moment of inertia and forgiveness.

As shown in FIGS. 7 and 8, the striking face 118 has a thickness that varies from a front surface 117 to the rear surface 119 to further promote more uniform ball speed across the striking face 118 of the golf club head 100. The striking face 118 includes a thickened portion 122 which at least partially overlaps a vertical plane perpendicular to a ground plane and passing through the face center of the golf club head 100 when in an address position. The thickened portion 122 is preferably between 1.6 mm and 2.6 mm thick, more preferably between 1.8 mm and 2.4 mm thick, and most preferably between 1.9 mm and 2.2 mm thick. The striking face 118 also includes a thinned portion 123 at least partially surrounding the thickened portion 122. The thinned portion 123 is preferably between 1.1 mm and 2.1 mm thick, more preferably between 1.35 mm and 1.85 mm thick, and most preferably between 1.5 mm and 1.7 mm thick. The thickness of the striking face 118 may gradually taper from the thickened portion 122 to the thinned portion 123 which may be located at an outer periphery of the striking face 118. The thickened portion 122 is preferably between 10% and 50% thicker than the thinned portion 123, more preferably between 20% and 40% thicker than the thinned portion 123, and most preferably between 25% and 35% thicker than the thinned portion 123. These thicknesses and relative dimensions are critical for maintaining consistent ball speeds across the striking face 118 and controlling stresses experienced by the striking face 118. The front surface of the damping element 125 engages the rear surface 119 of the striking face 118 at the thickened portion 122.

As shown in FIGS. 2, 3, and 8, the back portion 112 of the golf club head 100 may include a pocket 113 to allow a back weight 115 to be inserted into the pocket 113 from a rear of the golf club head 100. The back weight 115 allows the swing weight of the golf club head 100 to be customized based on player preference. The back weight 115 may be selected from a plurality of different masses having the same shape and volume to achieve a specific swing weight in a later stage of club head production. This allows for greater flexibility in customization of the golf club head 100. The back weight 115 may be fixed within the pocket 113 by welding or adhesive bonding to prevent unwanted removal once the proper back weight 115 is selected. In another embodiment, the back weight 115 may be removably secured within the pocket 113 by clamping or threaded engagement to allow greater interchangeability of the back weight 115.

Figure 10:
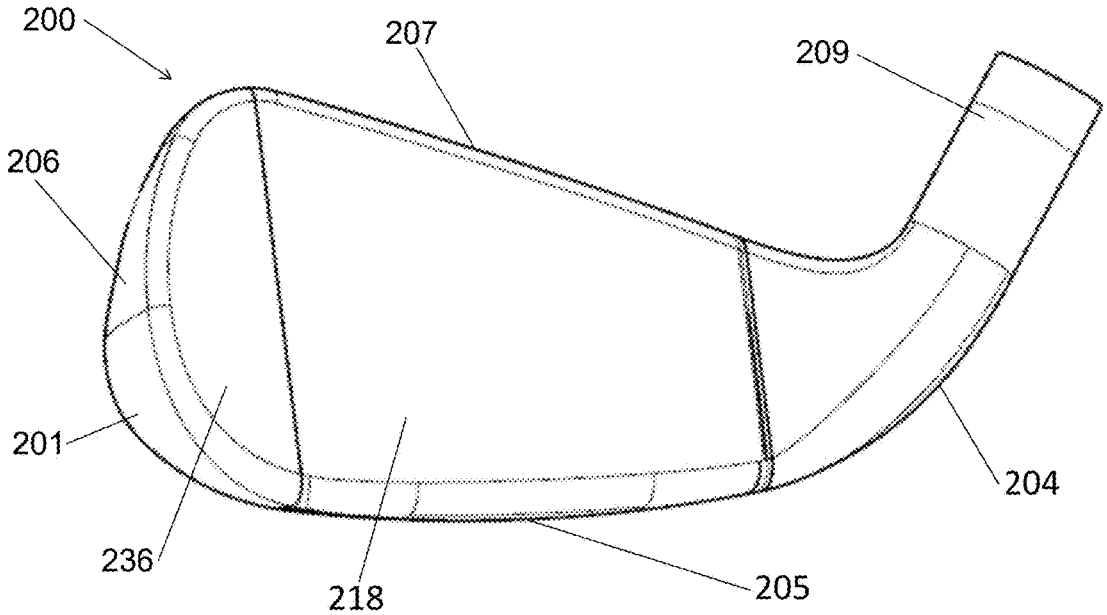
FIG. 10 depicts a front perspective view of a golf club head in accordance with another embodiment of the present invention.
Figure 11:
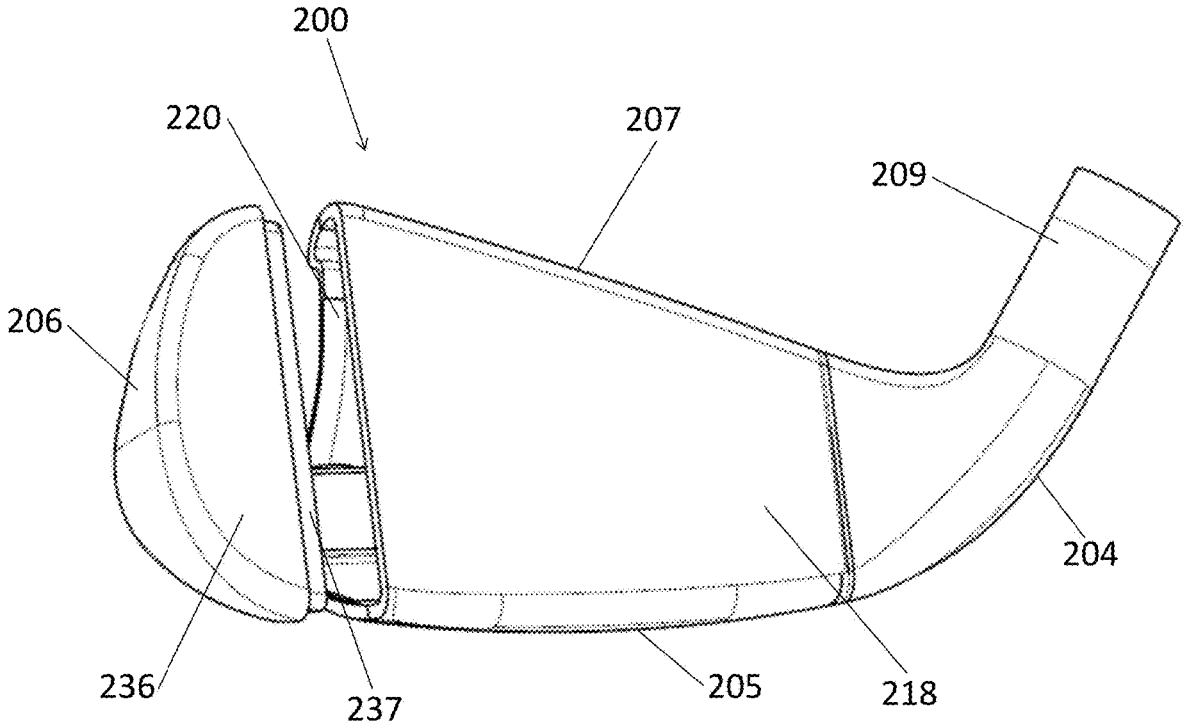
FIG. 11 depicts an exploded front perspective view of the golf club head of FIG. 10.
Figure 13:
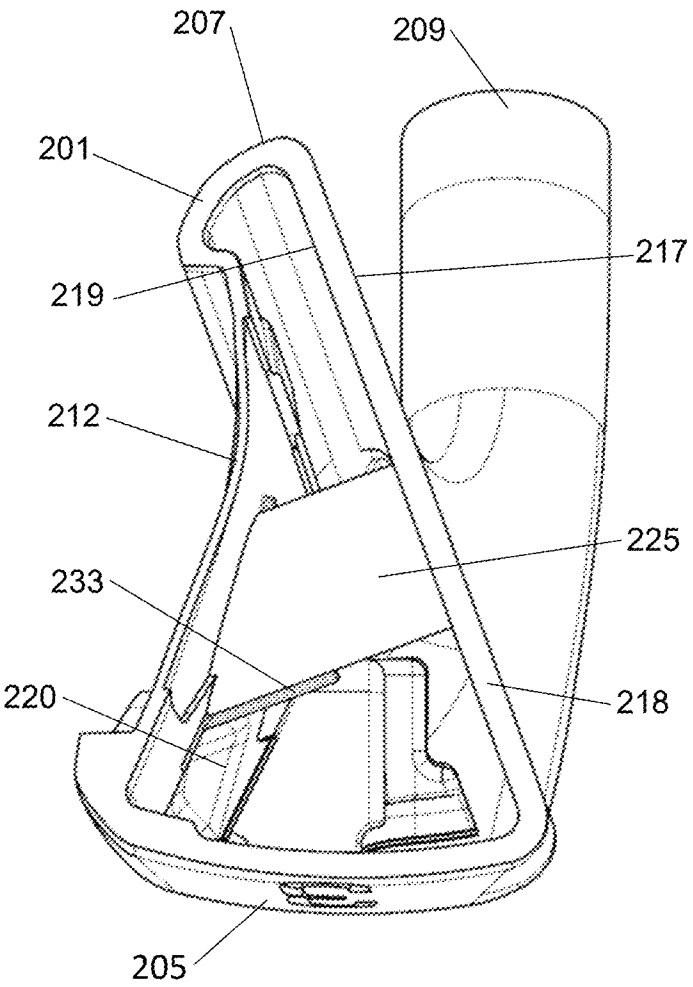
FIG. 13 depicts a cross-sectional view of the golf club head of FIG. 10.
Figure 12:
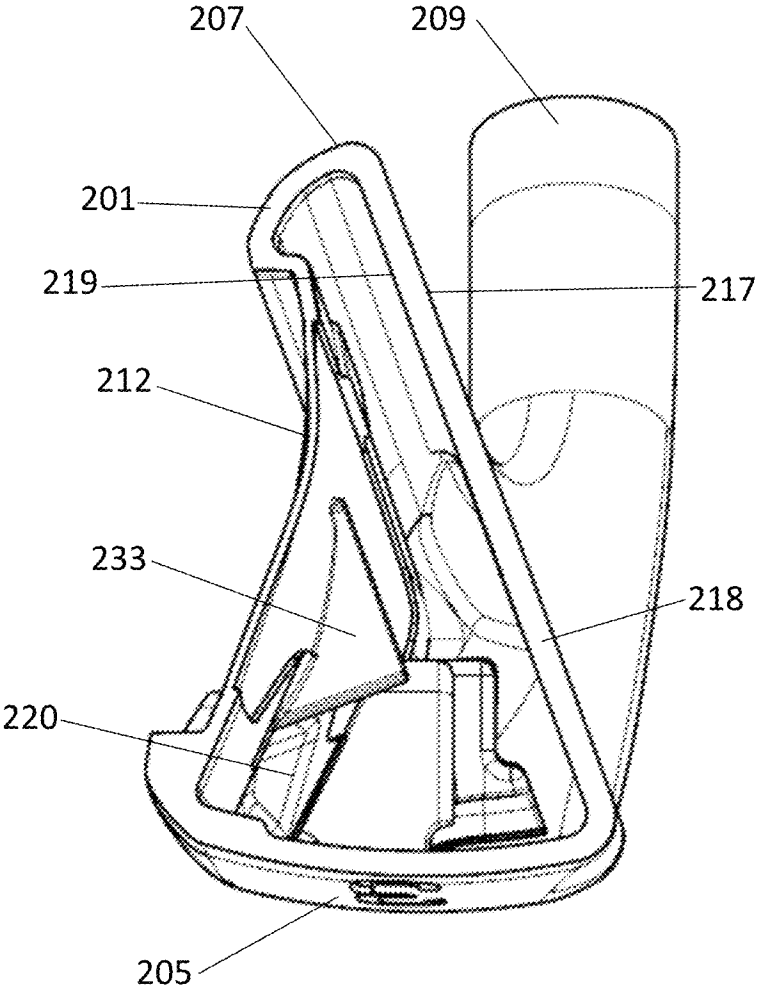
FIG. 12 depicts a cross-sectional view of the golf club head of FIG. 10.
Figure 14:
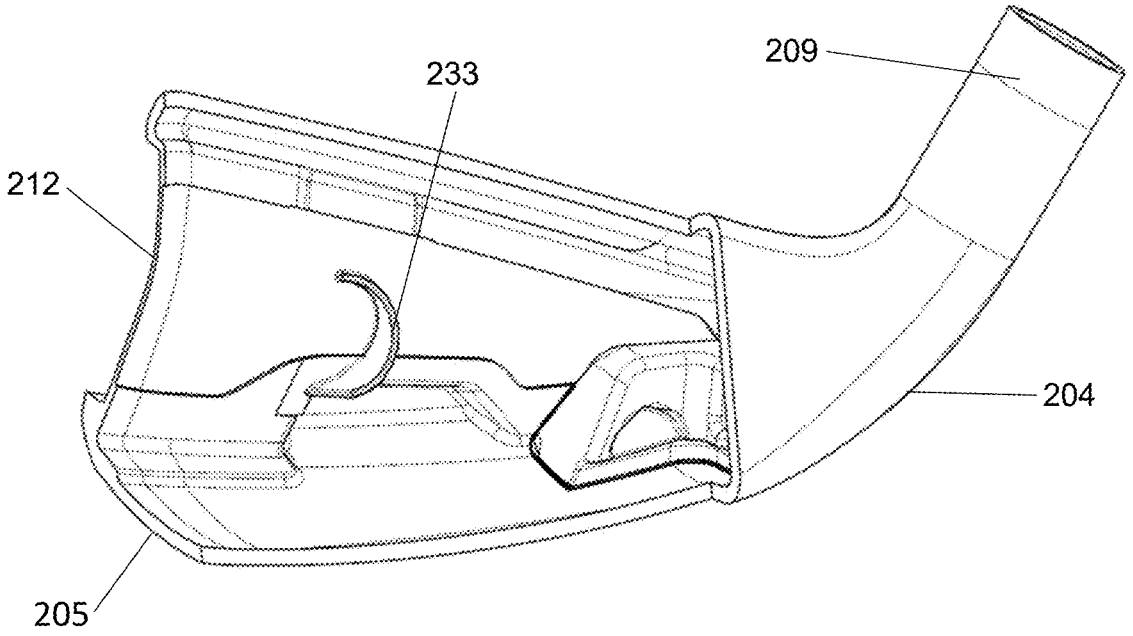
FIG. 14 depicts a front perspective view of a portion of the golf club head of FIG. 10 with the striking face removed.
Figure 15:
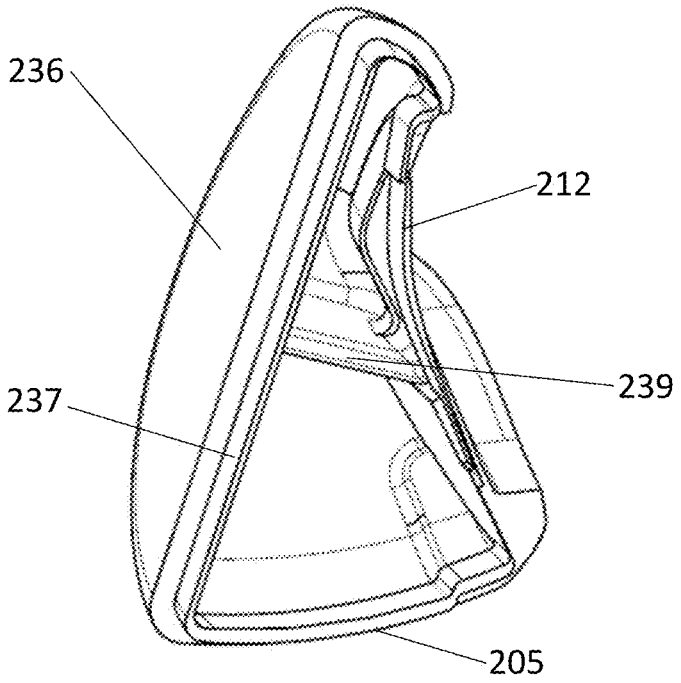
FIG. 15 depicts a side perspective view of a toe cap of the golf club head of FIG. 10.
Figure 16:
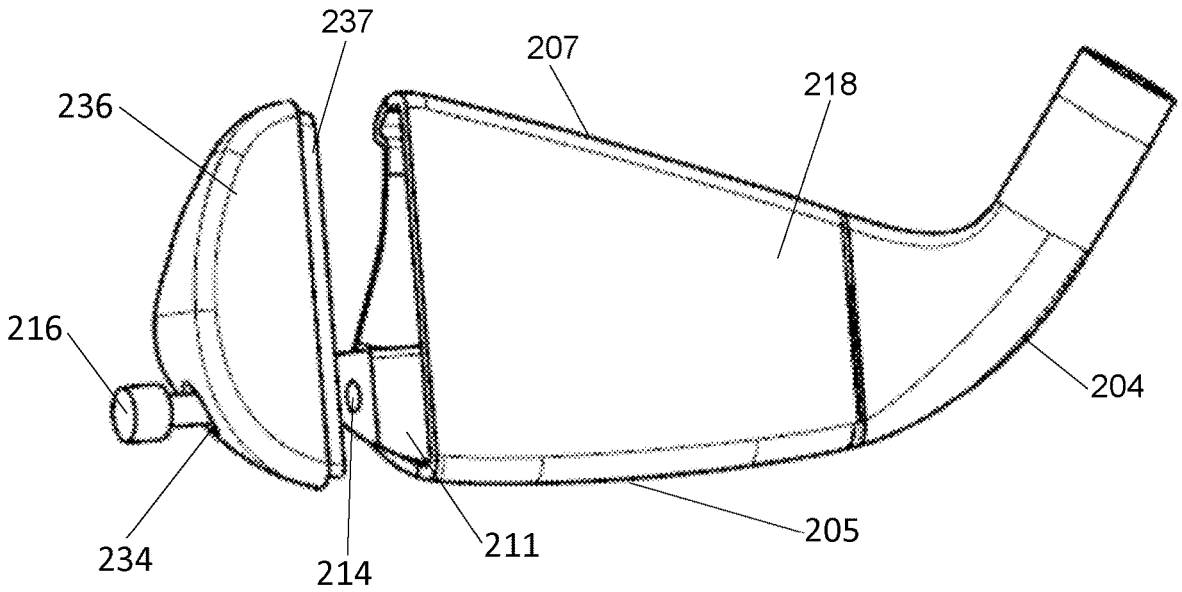
FIG. 16 depicts an exploded front perspective view of another embodiment of the golf club head of FIG. 10.
Figure 17:
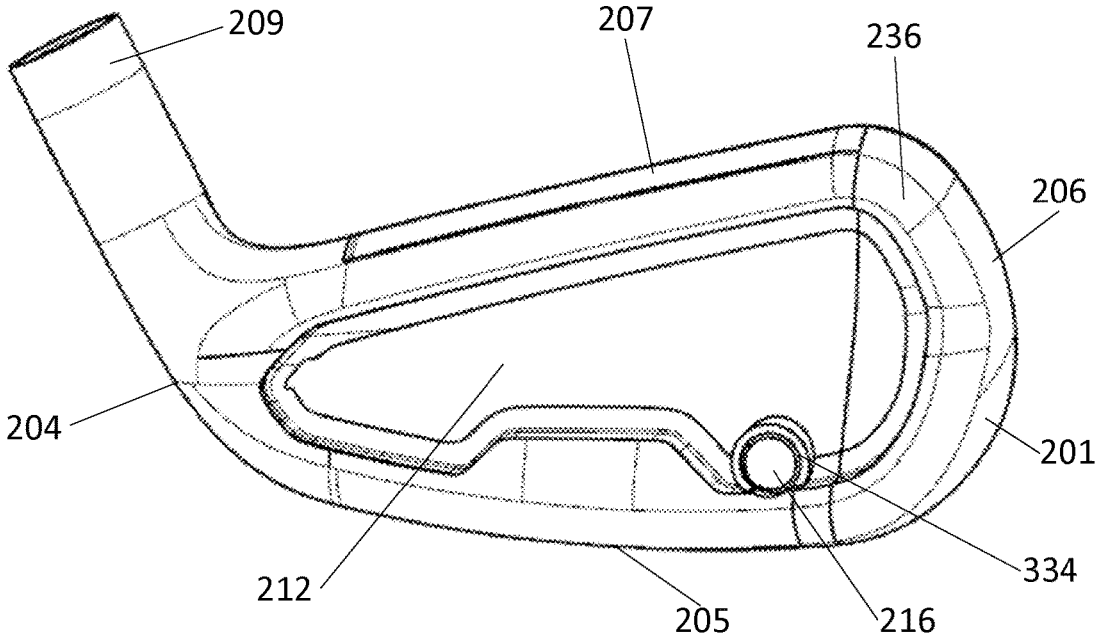
FIG. 17 depicts a rear perspective view of another embodiment of the golf club head of FIG. 10.
Figure 18:
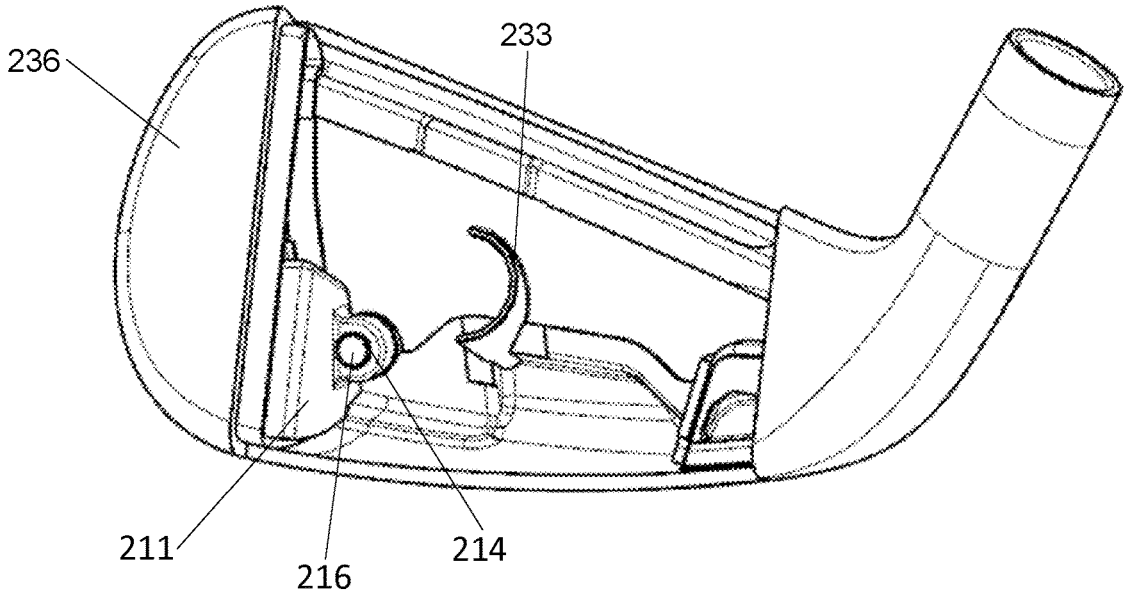
FIG. 18 depicts a front perspective view of a portion of the golf club head of FIG. 17 with the striking face removed.
Figure 19:
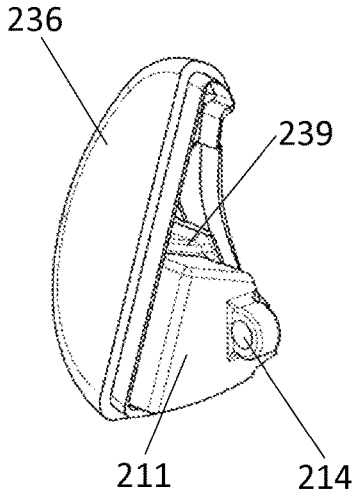
FIG. 19 depicts a side perspective view of a toe cap of the golf club head of FIG. 17.
Figure 20:
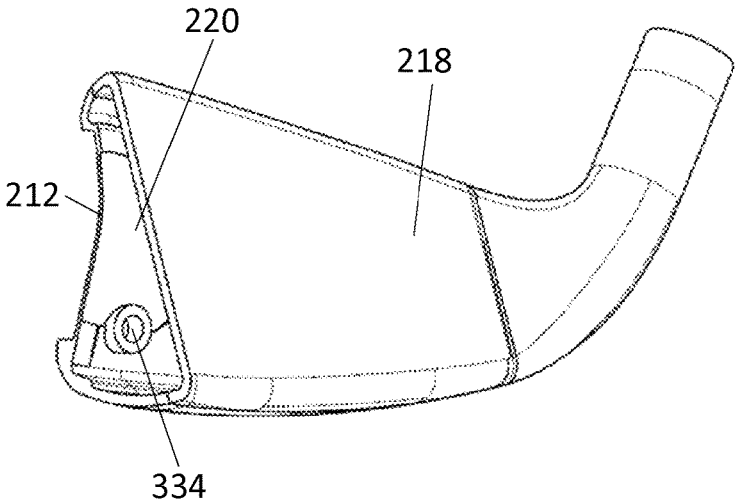
FIG. 20 depicts a front perspective view of a portion of the golf club head of FIG. 17.
Figure 21:
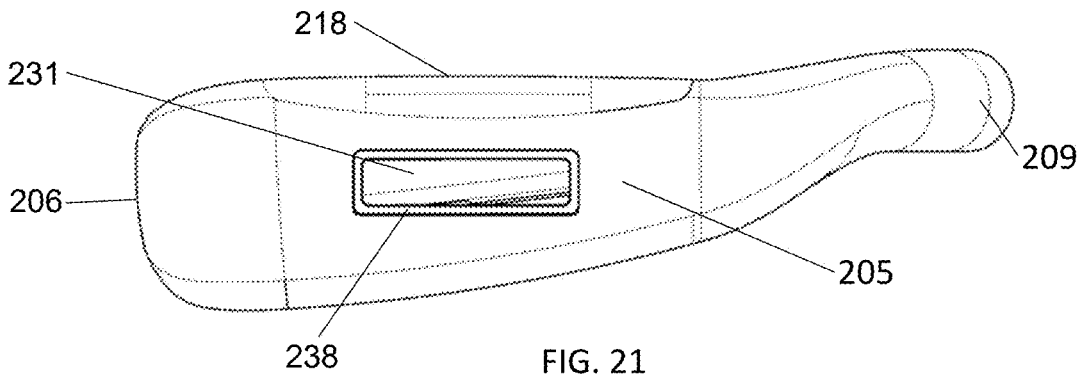
FIG. 21 depicts a bottom view of another embodiment of the golf club head of FIG. 10.
Figure 22:
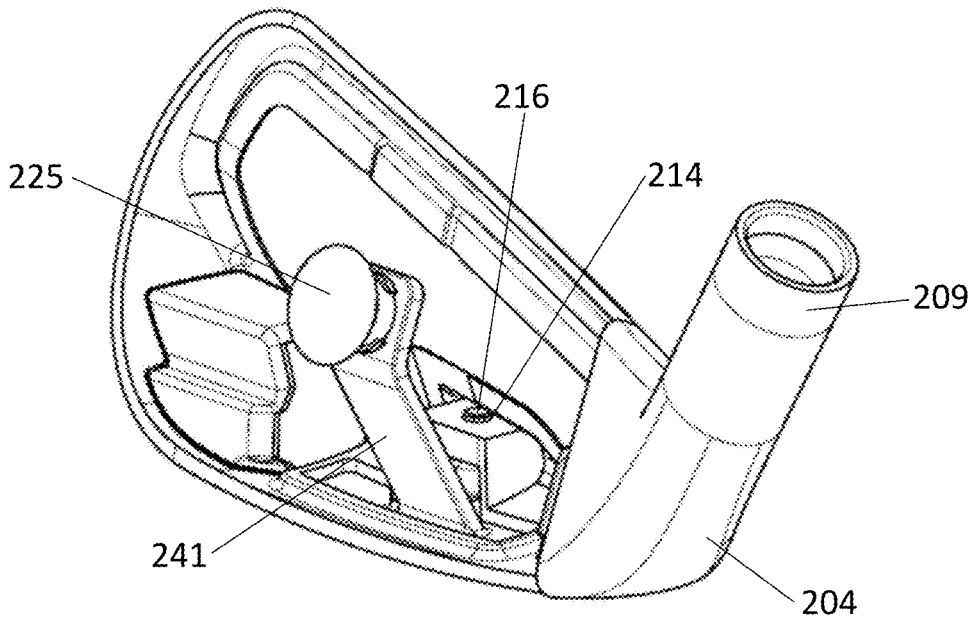
FIG. 22 depicts a front perspective view of another embodiment of the golf club head of FIG. 10 with the striking face removed.
Figure 23:
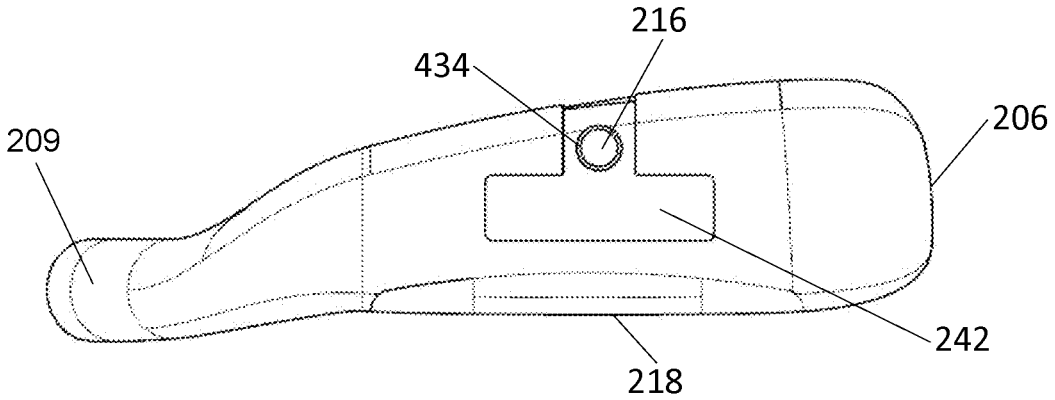
FIG. 23 depicts a bottom view of the golf club head of FIG. 22.
Figure 24:
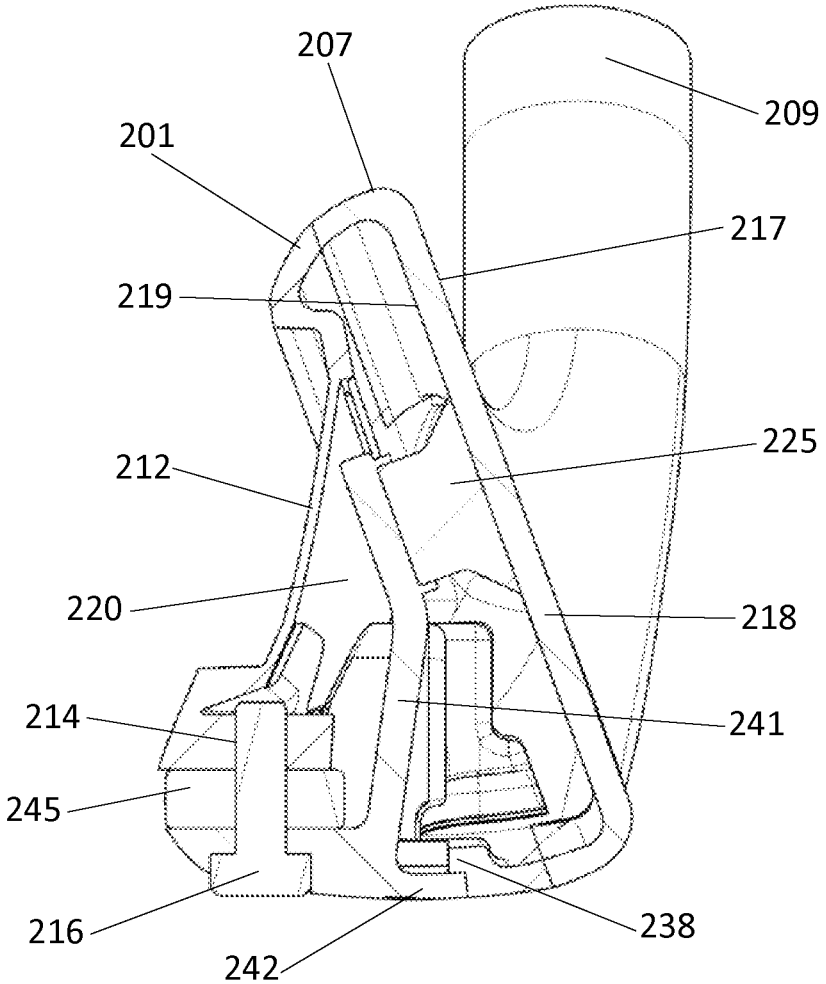
FIG. 24 depicts a cross-sectional view of the golf club head of FIG. 22.
Figure 25:
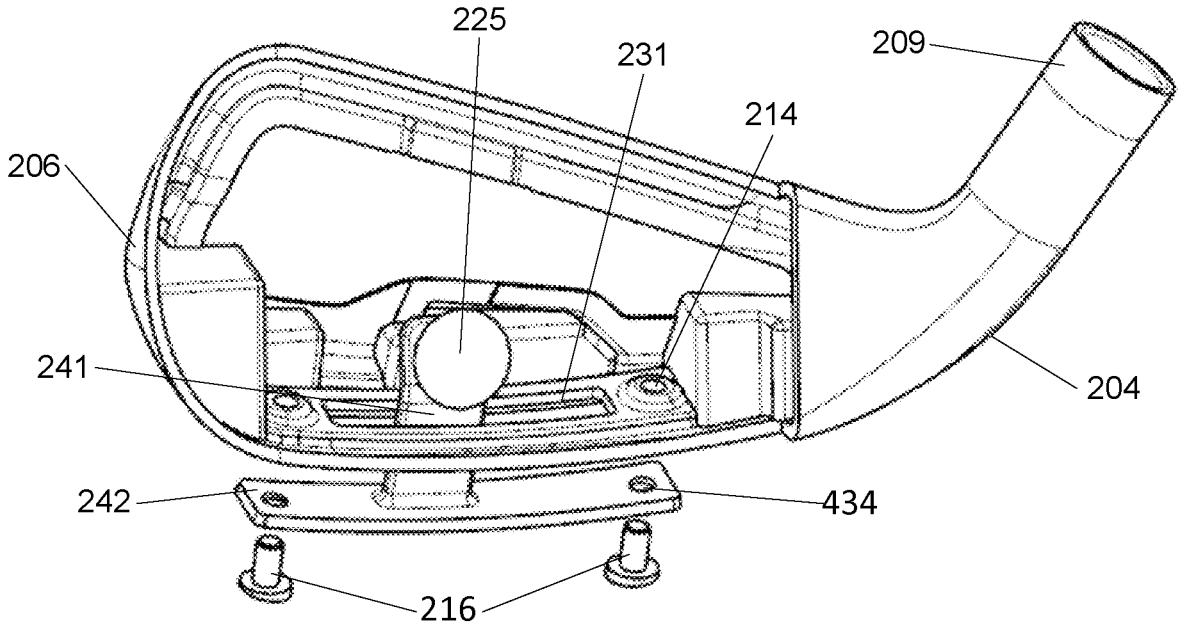
FIG. 25 depicts an exploded front perspective view of another embodiment of the golf club head of FIG. 10 with the striking face removed.
Figure 26:
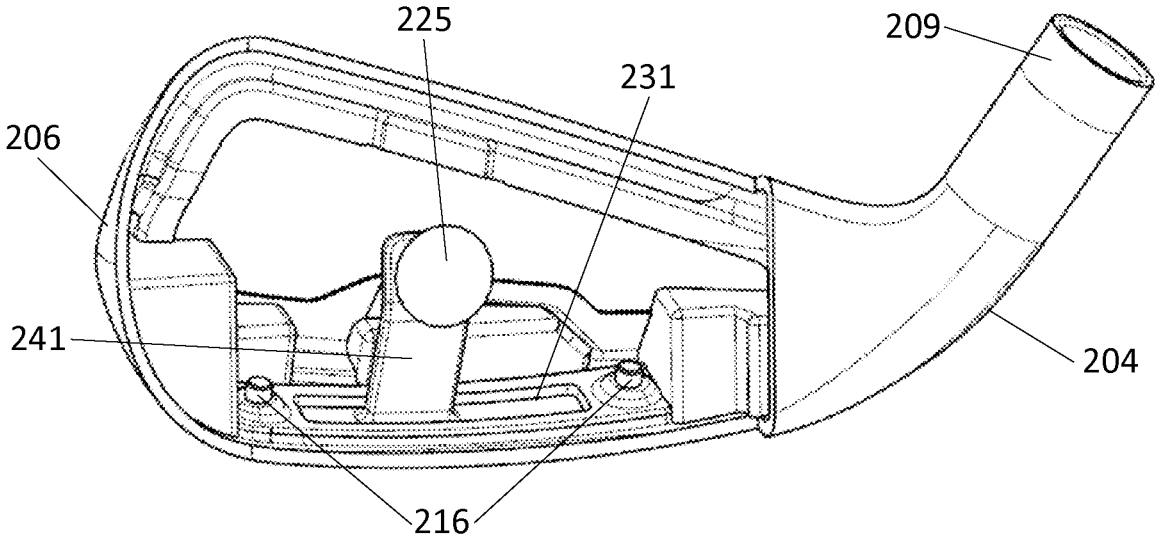
FIG. 26 depicts a front perspective view of the golf club head of FIG. 25 with the striking face removed.
Figure 27:
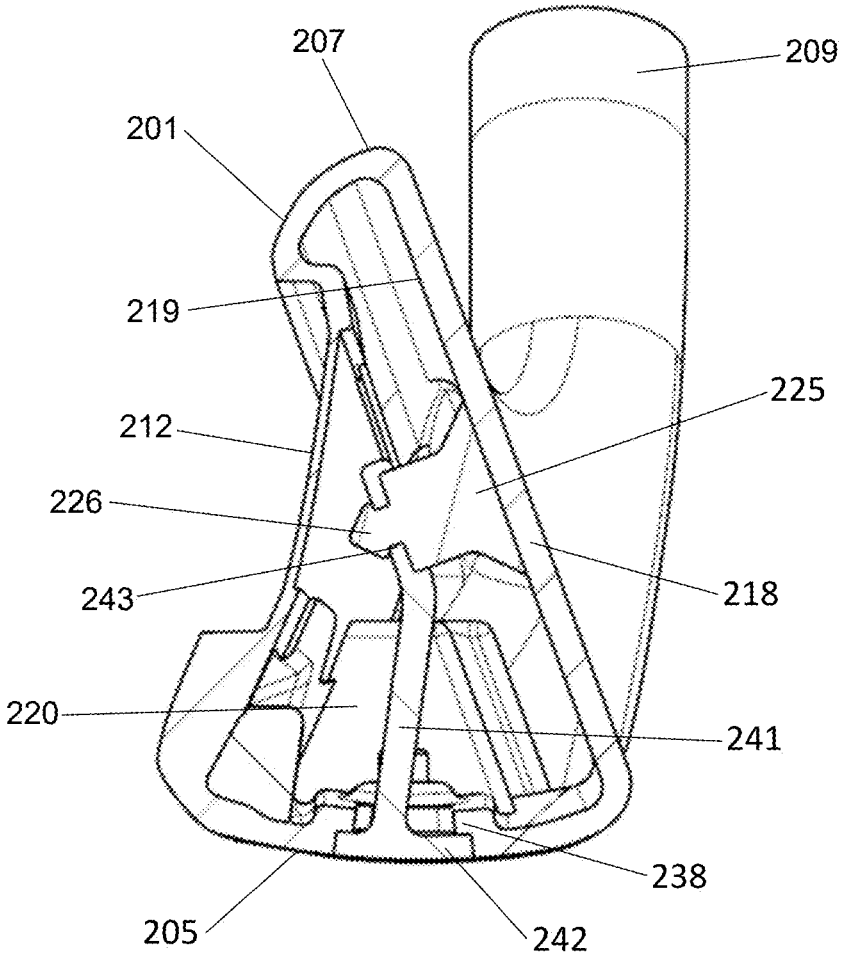
FIG. 27 depicts a cross-sectional view of the golf club head of FIG. 25.
Figure 28:
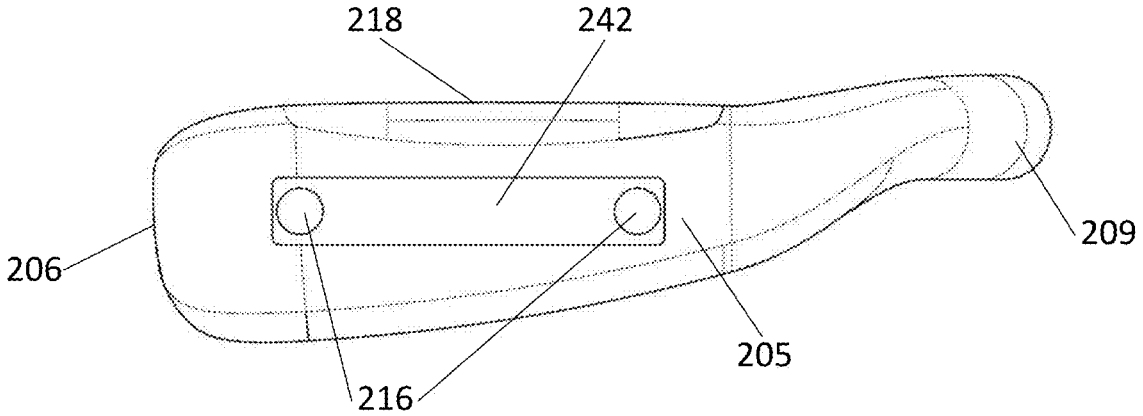
FIG. 28 depicts a bottom view of the golf club head of FIG. 25.

FIGS. 10-28 depict a golf club head 200 having a damping element 225 positioned behind the striking face 218. FIG. 10 depicts a front perspective view of the golf club head 200. FIG. 11 depicts an exploded front perspective view of the golf club head 200. FIG. 12 depicts a cross-sectional view of the golf club head 200 without the damping element 225. FIG. 13 depicts a cross-sectional view of the golf club head 200 with the damping element 225 installed. FIG. 14 depicts a front perspective view of the golf club head 200 with a toe cap 236 removed and the striking face 218 removed. FIG. 15 depicts a side perspective view of the toe cap 236. FIG. 16 depicts an exploded front perspective view of another embodiment of the golf club head 200. FIG. 17 depicts a rear perspective view of another embodiment of the golf club head 200. FIG. 18 depicts a front perspective view of the golf club head 200 of FIG. 17 with the striking face 218 removed. FIG. 19 depicts a side perspective view of the toe cap 236 of FIG. 17. FIG. 20 depicts a front perspective view of the golf club head 200 of FIG. 17 with the toe cap 236 removed. FIG. 21 depicts a bottom view of another embodiment of the golf club head 200 without the damping element 225. FIG. 22 depicts a bottom view of another embodiment of the golf club head 200. FIG. 23 depicts a front perspective view of the golf club head 200 of FIG. 22 with the striking face 218 removed. FIG. 24 depicts a cross-sectional view of the golf club head 200 of FIG. 22. FIG. 25 depicts an exploded front perspective view of another embodiment of the golf club head 200 with the striking face 218 removed. FIG. 26 depicts a front perspective view of the golf club head 200 of FIG. 25 with the striking face 218 removed. FIG. 27 depicts a cross-sectional view of the golf club head 200 of FIG. 25. FIG. 28 depicts a bottom view of the golf club head 200 of FIG. 25.

The golf club head 200 illustrated in FIGS. 10-28 is an iron type golf club head having a hollow body construction and includes a periphery portion 201 surrounding and extending rearward from a striking face 218. The periphery portion 201 includes a sole 205, a topline 207 opposite the sole 205, a heel side 204, and a toe side 206 opposite the heel side 204. The periphery portion 201 also includes a back portion 212 extending from the sole 205 to the topline 207 and extending from the heel side 204 to the toe side 206. The golf club head 200 includes a hosel 209 located on the heel side 204 configured to receive a shaft (not shown). A cavity 220 is formed between the periphery portion 201 and the striking face 218. The striking face 218 can be formed separately and welded to the periphery portion 201. In another embodiment, the striking face 218 may be formed integrally with the periphery portion 201.

As shown in FIGS. 10-20, the golf club head 200 further includes a damping element 225 located within the cavity 220. The damping element 225 has a front portion that contacts a rear surface 219 of the striking face 218. A rear portion of the damping element 225 contacts an interior surface of the back portion 212. The interior surface of the back portion 212 includes a raised lip 233 projecting towards the striking face 218 which is critical for positioning the damping element 225 in the proper orientation during assembly when visual inspection is obscured. The raised lip 233 has a shape which complements the shape of the side of the damping element 225 to prevent the damping element 225 from sliding or otherwise moving out of position once installed. In a preferred embodiment, the raised lip 233 has an arcuate shape to complement a rounded side of the damping element 225. In addition to the raised lip 233, the damping element 225 is generally held in place due to compression of the damping element 225 between the interior surface of the back portion 212 and the rear surface 219 of the striking face 218. The damping element 225 is configured to be installed in a set position during assembly and remain in that position. The raised lip 233 helps to ensure the damping element 225 is installed consistently and that the damping element 225 properly and consistently engages the rear surface 219 of the striking face 218 for optimal performance. An epoxy may be used to further secure the damping element 225 to the interior surface of the back portion 212 and/or the rear surface 219 of the striking face 218. The epoxy may also provide acoustic damping for desired sound characteristics.

The damping element 225 may have a generally cylindrical shape. In other examples, the damping element 225 may have a frustoconical, hemispherical, cuboid, or prism shape. The rear portion of the damping element 225 is formed to substantially match the shape of the interior surface of the back portion 212 which is contacts. The raised lip 233 may be welded or otherwise attached to the back portion 212, or the raised lip 233 may be formed as part of the back portion 212 during a casting or forging process. The back portion 212 may also be machined to include the raised lip 233. The raised lip 233 is oriented substantially perpendicular to the rear surface 219 of the striking face 218. The raised lip 233 does not come into contact with the rear surface 219 of the striking face 218 at maximum deflection thereof. The raised lip 233 itself may be made of the same material as the back portion 212, such as a steel. The raised lip 233 may also be made from titanium, aluminum, composite, or ceramic materials.

As shown in FIGS. 11, 14-16, 19, and 20, at least a portion of the periphery portion 201 at the toe side 206 defines a toe cap 236 which is formed separate from a remainder of the golf club head 200. The damping element 225 may be installed within the cavity 220 when the toe cap 236 is separated from the remainder of the golf club head 200. This is critical for allowing the damping element 225 to be positioned between the interior surface of the back portion 212 and the rear surface 219 of the striking face 218 after the striking face 218 has been welded or otherwise attached to the periphery portion 201. In one embodiment where the striking face 218 is welded to the periphery portion 201, installing the damping element 225 after the striking face 218 has been welded protects the damping element 225 from adverse heat effects that the damping element 225 would be subjected to if it were installed prior to the welding process. In another embodiment where the striking face 218 is formed integrally with the periphery portion 201, installing the damping element 225 within the cavity 220 while the toe cap 236 is separated allows more precise placement of the damping element 225 and more consistent compression of the damping element 225. The raised lip 233 assists in guiding the damping element 225 to its proper position. Once the damping element 225 is installed, the toe cap 236 is secured to the remainder of the golf club head 200 to prevent unwanted debris and moisture from entering the cavity 220. The toe cap 236 may be attached by welding, preferably pulse welding. Pulse welding the toe cap 236 to the remainder of the golf club head 200 involves welding smaller sections of the weld path in multiple passes. This is critical for allowing the golf club head 200 to cool down in between welding passes to prevent excessive heat exposure to the damping element 225. Alternatively, the toe cap 236 may be attached using an adhesive to prevent excessive heat exposure to the damping element 225. The toe cap 236 may include a ledge 237 configured to slide within the cavity 220 for alignment purposes and to adhere to an inner boundary portion of the cavity 220 for secure attachment. The toe cap 236 is located entirely toeward of the toewardmost extent of any scorelines formed on the striking face 218. The location of the toe cap 236 on the toe side 206 provides greater access area to the cavity 220 for installing the damping element 225. Additionally, the location of the toe cap 236 on the toe side 206 provides a greater separation distance from the heat exposure for the damping element 225 when the toe cap 236 is welded to the remainder of the golf club head 200. As shown in FIG. 15, the toe cap 236 may include a rib 239 extending between a front interior surface and a rear interior surface to provide structural stability and improved sound characteristics. The toe cap 236 may be made of steel, titanium, aluminum, or composite material in order to achieve desired mass properties.

FIGS. 16-20 show alternative ways to attach the toe cap 236 to the remainder of the golf club head 200. As shown in FIG. 16, The toe cap 236 may include an aperture 234 extending through the toe side 206. In this embodiment, the cavity 220 includes a weight member 211 having a threaded bore 214. The aperture 234 in the toe cap 236 is configured to align with the threaded bore 214 in the weight member 211 and allow a fastener 216 to pass through the aperture 234 and threadedly engage the threaded bore 214. The toe cap 236 may include adhesive to provide additional securement between the toe cap 236 and the remainder of the golf club head 200. FIGS. 17-20 show an additional embodiment where the back portion 212 of the golf club head 200 includes an aperture 334 which is configured to align with a threaded bore 214 in a weight member 211 that is positioned within an interior of the toe cap 236. A fastener 216 is configured to pass through the aperture 334 and threadedly engage the threaded bore 214 to secure the toe cap 236 to the remainder of the golf club head 200. This attachment means can be combined with an adhesive to provide additional attachment strength.

In a preferred method of manufacturing the golf club head 200, the striking face 218 is welded to, or integrally formed with, the periphery portion 201. The damping element 225 is then inserted into the cavity 220 while the toe cap 236 is separated from the remainder of the golf club head 200. The damping element 225 is positioned between interior surface of the back portion 212 and the rear surface 219 of the striking face 218. The raised lip 233 assists in locating the proper positioning of the damping element 225 and helps prevent unwanted movement of the damping element 225 once properly installed. The toe cap 236 is then adhered or welded to the remainder of the golf club head 200 to enclose the cavity 220.

FIGS. 21-28 show additional embodiments of the golf club head 200 with alternative ways to install the damping element 225 in the cavity 220. In the embodiments shown in FIGS. 21-28, the damping element 225 is installed within the cavity 220 through an aperture 231 in the sole 205. In these embodiments, the rear portion of the damping element 225 is secured to a support arm 241 which is then inserted into the cavity 220 through the aperture 231. The support arm 241 includes a base member 242 configured to abut a ledge 238 located along a periphery of the aperture 231 in the sole 205. The base member 242 of the support arm 241 may be adhered to the ledge 238 to secure the support arm 241 and the damping element 225 within the cavity 220. In one embodiment, the periphery portion 201 of the golf club head 200 may be made of steel while the support arm 241 may be made of a less dense material, preferably titanium, aluminum, plastic, or composite material. By using a less dense material for the support arm 241, the heavier steel of the sole 205 is replaced with the lighter material of the base member 242 of the support arm 241 at the location of the aperture 231. This allows for greater discretionary mass to be placed elsewhere in the golf club head 200. The ability of the support arm 241 to be made from different materials is critical for allowing adjustability of swing weight for the golf club head 200 as well as adjustability of the stiffness of the support arm 241 which, in conjunction with the damping element 225, affects the ball speed performance across the striking face 218.

As shown in FIGS. 22-28, the base member 242 may include at least one aperture 434 configured to align with at least one threaded bore 214 within the golf club head 200. At least one fastener 216 is configured to pass through the at least one aperture 434 and threadedly engage the at least one threaded bore 214 to secure the base member 242 to the sole 205 of the golf club head 200. When the base member 242 is secured along the sole 205, the damping element 225 is positioned with the front portion of the damping element 225 contacting the rear surface 219 of the striking face 218 as shown in FIGS. 24 and 27. In the embodiment shown in FIG. 24, a spacer 245 may be positioned between the base member 242 and the at least one threaded bore 214. The height of the spacer 245 in the sole-to-topline direction affects the force that the damping element 225 exerts on the striking face 218 via the orientation of the support arm 241. A spacer 245 having less height will result in the support arm 241 hinging closer to the striking face 218 and thus providing greater rigidity to the striking face 218. A spacer 245 having greater height will result in the support arm 241 hinging further from the striking face 218 and thus providing less rigidity to the striking face 218. A user may select from a variety of heights for the spacer 245 in order to achieve desired ball speeds across the striking face 218. The rear portion of the damping element 225 may be adhered to the support arm 241. Additionally, the rear portion of the damping element 225 may have a barb portion 226 that is positioned through an aperture 243 in the support arm 241, as shown in FIG. 27, to provide additional attachment strength.

In traditional thin face golf clubs, strikes at the geometric center of the striking face display the largest displacement of the striking face, and thus the greatest ball speeds. By disposing the damping element 225 proximate the geometric center of the striking face 218, the deflection of the striking face 218 at that point is reduced, thus reducing the ball speed. Portions of the striking face 218 not backed by the damping element 225, however, continue to deflect into the cavity 220 contributing to the speed of the golf ball. As such, a more uniform distribution of ball speeds resulting from ball strikes across the striking face 218 from the heel side 204 to the toe side 206 may be achieved.

The elasticity of the damping element 225 affects the deflection of the striking face 218. For instance, a material with a lower elastic modulus allows for further deflection of the striking face 218, providing for higher maximum ball speeds but less uniformity of ball speeds. In contrast, a material with a higher elastic modulus further prevents deflection of the striking face 218, providing for lower maximum ball speeds but more uniformity of ball speeds. For some applications, a range of elastic moduli for the damping element 225 from about 4 MPa to about 15 GPa may be used. In other applications, a range of elastic moduli for the damping element 225 from about 15 GPa to about 40 GPa may be used. To achieve the goal of having the carry distance of off-center shots closer to the carry distance of center shots, the material for the damping element 225 may have an elastic modulus of about 40 GPa or greater, and more preferably about 70 GPa or greater. The material for the damping element 225 may be a polymer, preferably silicone, to achieve the lower elastic modulus for higher ball speeds or a metal such as aluminum, steel, or titanium to achieve the higher elastic modulus for more consistent carry distances across the striking face 218. Although the maximum ball speed for impacts at the center decreases when the damping element 225 has a higher elastic modulus, the speed retention across the striking face 218 is improved. This is desirable for golfers who want more consistent carry distance from strikes across the striking face 218 rather than maximizing overall carry distance.

The damping element 225 has a free thickness and an installed thickness measured in the front-to-rear direction. In some embodiments, the free thickness and the installed thickness of the damping element 225 can be substantially the same. In this case, there would be little to no preload of the damping element 225 against the rear surface 219 of the striking face 218. In other embodiments, the installed thickness can be lower than the free thickness, creating a preload force on the rear surface 219 of the striking face 218. This preload force can change the coefficient of restitution of the striking face 218. In an additional embodiment, multiple versions of the damping element 225 may be available with different free thicknesses to achieve a particular coefficient of restitution. Alternatively, the material of the damping element 225 could be altered to change its stiffness, thus altering the coefficient of restitution of the golf club head.

A higher compression of the damping element 225 against the rear surface 219 of the striking face 218 further restricts the deflection of the striking face 218. In turn, further restriction of the deflection causes more uniform ball speeds across the striking face 218. However, the restriction on deflection also lowers the maximum ball speed from the center of the striking face 218. To achieve a golf club head 200 that produces further maximum distance, but does not need uniform ball speed across the striking face 218, the initial set compression of the damping element 225 can be reduced, or a damping element 225 having a lower elastic modulus can be used. In contrast, to achieve a golf club head 200 that has more uniform ball speed across the striking face 218, the initial set compression of the damping element 225 can be increased, or a damping element 225 having a higher elastic modulus can be used. This adjustability is critical for meeting a variety of specific performance needs for different individuals.

The inclusion of the damping element 225 in the golf club head 200 provides benefits in durability for the striking face 218 by reducing stress values displayed by the striking face 218 upon impact with a golf ball. Without the damping element 225, the von Mises stress levels are high and indicate that the striking face 218 may be susceptible to failure and/or early deterioration. Such von Mises stress values are lower with the damping element 225 and are indicative of a more durable golf club head 200 that is less likely to fail.

Another goal of the damping element 225 described herein is to dissipate energy of the golf club head after it strikes a golf ball. As the striking face 218 and other portions of the golf club head vibrate, the damping element 225 in contact with those surfaces can dissipate the energy. This can change the sound produced by the golf club head 200 by reducing the loudness and/or duration of the sound produced when the golf club head 200 strikes a golf ball.

Other than in the operating examples, or unless otherwise expressly specified, all of the numerical ranges, amounts, values, and percentages may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. A golf club head comprising:

a striking face having a front surface configured to strike a golf ball and a rear surface opposite said front surface;

a periphery portion extending rearward from said striking face and including a sole, a topline opposite said sole, a heel side, a toe side opposite said heel side, and a back portion extending from said sole to said topline and from said heel side to said toe side;

a hosel configured to receive a shaft, said hosel located on said heel side;

a cavity formed between said periphery portion and said striking face;

a toe cap defined by at least a portion of said periphery portion at said toe side, said toe cap being a separate component from a remainder of said golf club head;

a damping element positioned between said back portion and said rear surface of said striking face; and a weight member positioned within said cavity, wherein said toe cap includes an aperture configured to align with a threaded bore within said weight member, and wherein a fastener extends through said aperture and is engaged with said threaded bore.

2. The golf club head of claim 1, further comprising a raised lip projecting from an interior surface of said back portion towards said striking face, wherein said raised lip abuts said damping element, and wherein said raised lip has a shape that complements a side of said damping element.

3. The golf club head of claim 1, wherein said toe cap includes a ledge configured to fit within an inner boundary portion of said cavity.

4. The golf club head of claim 3, wherein said ledge is adhered to said inner boundary portion of said cavity.

5. The golf club head of claim 1, wherein said toe cap is made from titanium, aluminum, or composite material.

6. The golf club head of claim 1, wherein said damping element has a cylindrical shape, and wherein a longitudinal axis of said damping element is perpendicular to said striking face.

7. The golf club head of claim 1, wherein said toe cap is welded to said remainder of said golf club head.

8. A golf club head comprising:

a striking face having a front surface configured to strike a golf ball and a rear surface opposite said front surface;

a periphery portion extending rearward from said striking face and including a sole, a topline opposite said sole, a heel side, a toe side opposite said heel side, and a back portion extending from said sole to said topline and from said heel side to said toe side;

a hosel configured to receive a shaft, said hosel located on said heel side;

a cavity formed between said periphery portion and said striking face;

a toe cap defined by at least a portion of said periphery portion at said toe side, said toe cap being a separate component from a remainder of said golf club head;

a damping element positioned between said back portion and said rear surface of said striking face; and a weight member positioned within said toe cap, wherein said back portion includes an aperture configured to align with a threaded bore within said weight member, and wherein a fastener extends through said aperture and is engaged with said threaded bore.

* * * * *